US007513291B2

(12) United States Patent
Colson et al.

(10) Patent No.: US 7,513,291 B2
(45) Date of Patent: Apr. 7, 2009

(54) CONTROL SYSTEM FOR VERTICAL COVERING FOR ARCHITECTURAL OPENINGS

(75) Inventors: Wendell B. Colson, Weston, MA (US); Joseph E. Kovach, Brighton, CO (US); Paul F. Josephson, Longmont, CO (US); Marek Jarosinski, Brighton, CO (US); Daniel Fluckey, Denver, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 159 days.

(21) Appl. No.: 11/474,555

(22) Filed: Jun. 26, 2006

(65) Prior Publication Data

US 2007/0000620 A1 Jan. 4, 2007

Related U.S. Application Data

(60) Provisional application No. 60/696,169, filed on Jun. 30, 2005.

(51) Int. Cl.
*A47H 5/00* (2006.01)

(52) U.S. Cl. ..... 160/84.04; 160/84.05; 160/84.06; 160/172 V; 160/1; 160/168.1 V

(58) Field of Classification Search ..... 160/84.04, 160/84.05, 84.06, 172 V, 1, 168.1 V
See application file for complete search history.

(56) References Cited

U.S. PATENT DOCUMENTS

| | | | | |
|---|---|---|---|---|
| 4,677,013 | A | 6/1987 | Anderson | |
| 5,301,733 | A * | 4/1994 | Toti | 160/84.01 |
| 5,749,404 | A * | 5/1998 | Colson | 160/84.04 |
| 6,152,205 | A | 11/2000 | Toti | |
| 6,533,017 | B1 | 3/2003 | Toti | |
| 7,270,165 | B1 * | 9/2007 | Chuang | 160/197 |
| 2003/0094247 | A1 * | 5/2003 | Voss et al. | 160/84.05 |

* cited by examiner

*Primary Examiner*—Katherine W Mitchell
*Assistant Examiner*—Philip S Kwon
(74) *Attorney, Agent, or Firm*—Dorsey & Whitney LLP

(57) ABSTRACT

A covering for an architectural opening includes a fabric adapted to be extended across the opening or retracted adjacent one side of the opening. The fabric has one fixed edge along one side of the opening and an opposite movable edge. The movable edge is guided by a flexible metal tape disposed in a generally Z-shaped configuration that extends slidably along the movable edge of the fabric and in opposite perpendicular directions at opposite ends of the movable edge for variable lengths.

15 Claims, 26 Drawing Sheets

CONTROL SYSTEM FOR VERTICAL COVERING FOR ARCHITECTURAL OPENINGS

CROSS-REFERENCE TO RELATED APPLICATION

The present application claims the benefit under 35 U.S.C. § 119(e) to U.S. Provisional Patent Application No. 60/696,169 ("the '169 application"), which was filed on Jun. 30, 2005 and entitled "Control System For Vertical Covering For Architectural Openings." The '169 application is incorporated by reference into the present application in its entirety.

BACKGROUND OF THE INVENTION

1. Field of the Invention

The present invention relates generally to coverings for architectural openings such as windows, doorways, archways, and the like, and more particularly to a vertically oriented shade anchored along a fixed edge to the frame of the architectural opening and having its opposite edge movable in a vertical plane within the architectural openings. A flexible, metal tape extends variably along one side of the opening perpendicularly to the fixed and movable edges of the shade, along the movable edge of the shade, and along a second side of the opening opposite the one side of the opening and in an opposite direction from the movable edge of the shade to positively but removably position the movable edge of the shade at any location within the architectural openings.

2. Description of the Relevant Art

Coverings for architectural openings such as windows, doors, archways, and the like have been in use for many years. Such coverings were initially simply fabric draped across the opening, but, in more recent years, retractable coverings have become popular. Such retractable coverings include venetian blinds, wherein horizontally disposed slats are suspended on cord or tape ladders so as to be vertically extended across the opening or retracted in stacked relationship along the top edge of the opening while each slat in the extended condition of the blind is capable of being pivoted about its longitudinal horizontal axis between open and closed positions. Vertical blinds are also available which work on the same principle as venetian blinds except where the slats are vertically suspended from a top edge and pivotal about longitudinal vertical axes.

Cellular shades have become popular in recent years wherein in one arrangement, a plurality of tubular cells are interconnected with the cells being transversely collapsible so that in an extended condition of the shade, the tubular cells are expanded and in aggregate extend across the architectural opening but can be retracted adjacent an edge of the opening with the cells transversely collapsed into closely adjacent stacked relationship with each other.

Similarly, some cellular shades are retracted onto a roller with an example being a shade wherein a pair of flexible fabric sheets, such as sheer, are suspended from a roller and interconnected by a plurality of vertically spaced horizontally extending flexible vanes. By shifting one sheet vertically relative to the other, the vanes are moved between open and closed positions. In the open condition, the vanes are disposed substantially horizontally to define spaces therebetween through which light and vision can pass and in the closed position are generally vertically oriented in parallel relationship with the sheets to block light and vision through the shade.

Many residential and commercial building structures utilize sliding doors in an architectural opening to provide access to the structure and coverings for such architectural openings can take numerous forms such as vertical blinds, venetian blinds, or roll-up or collapsible cellular shades. Alternative to these systems might be desirable for aesthetic purposes or to provide a system which would be more controllable.

It is to provide alternatives to conventional coverings for architectural openings, and particularly one which might have a use in an architectural opening with a sliding glass door, that the present invention has been developed.

SUMMARY OF THE INVENTION

The covering of the present invention is illustrated in the form of a transversely collapsible cellular shade wherein the cells of the fabric of the shade are oriented vertically even though other fabrics or shade materials could be utilized as will be appreciated from the detailed description that follows. The cellular fabric as illustrated is suspended from a top rail in an architectural opening by a plurality of hangers along the top edge of the fabric. One vertical edge of the fabric is anchored to the framework of the architectural opening with a fixed vertical rail while the opposite vertical edge is anchored to a movable vertical rail with a handle for moving the associated edge of the fabric horizontally across the opening between fully extended and retracted positions. In the retracted position, the movable rail is positioned closely adjacent to the fixed vertical rail with the cells of the fabric transversely collapsed in a neat stack between the fixed and movable rails. In the extended position, the movable rail is positioned at the opposite side of the opening from the fixed rail so the fabric extends across the opening. As will be appreciated with the description that follows, the movable rail can be positioned at any location within the opening so that the fabric extends across the opening to any desired extent.

The movable vertical rail is adapted to follow a flexible steel tape having a lower end anchored to the opening frame adjacent the fixed vertical rail, a horizontal run extending along the bottom of the fabric to the bottom of the movable vertical rail, a vertical run extending slidably through the vertical rail, an upper horizontal run extending in the opposite direction from the movable vertical rail from the lower horizontal run and an upper end anchored to the opening frame at the top of the opening at the opposite edge of the opening from the fixed vertical rail.

As the movable vertical rail is moved horizontally across the opening, the flexible metal tape slides along the vertical extent of the movable rail causing either the upper run or the lower run to become shorter as the opposite horizontal run becomes longer. The tape thereby provides a variable guide for the movable vertical rail so that the covering can be releasably but positively positioned at any location between the fully extended and fully retracted positions of the covering.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
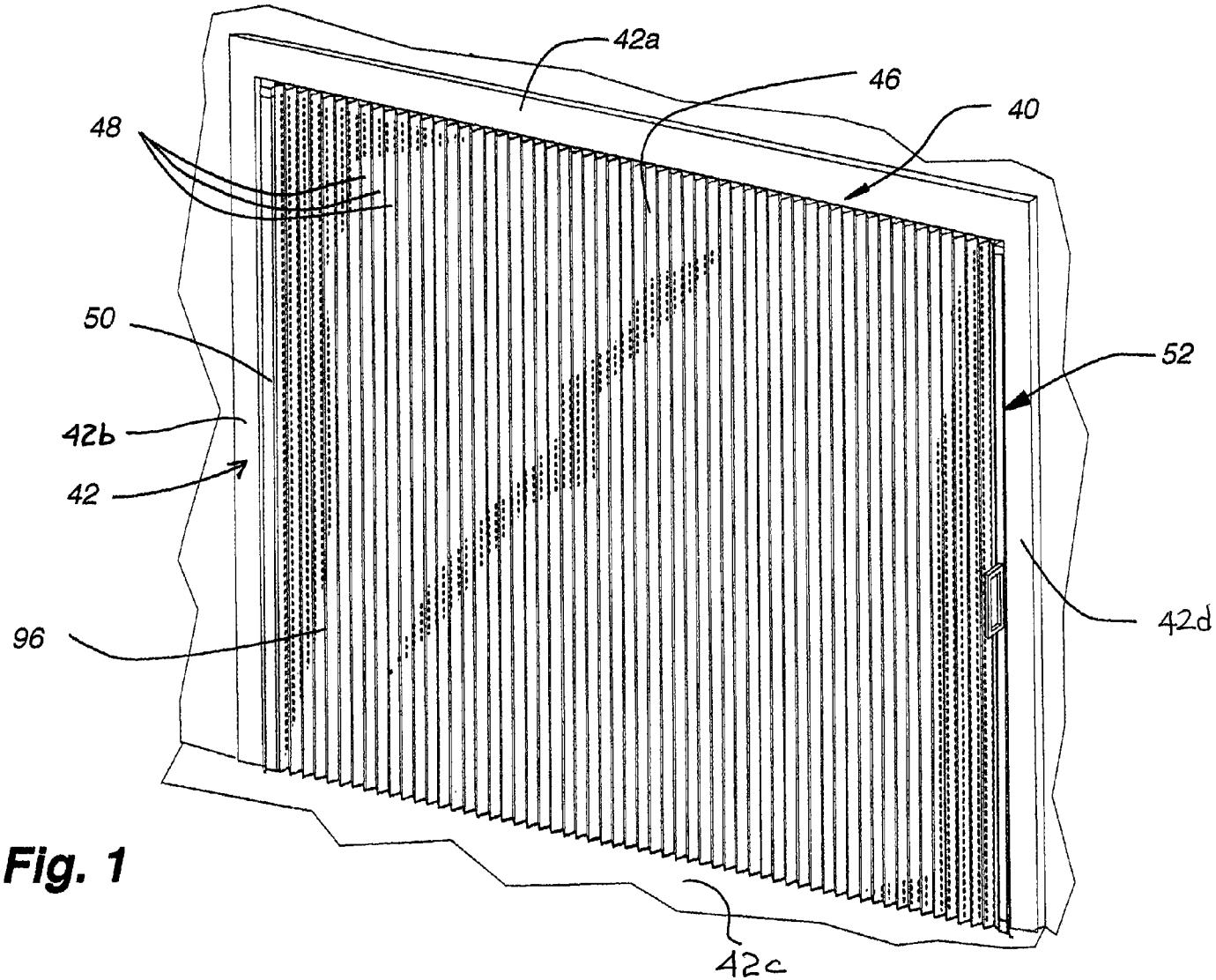
FIG. 1 is a fragmentary isometric showing the covering of the present invention in a fully extended condition across an architectural opening.
Figure 2:
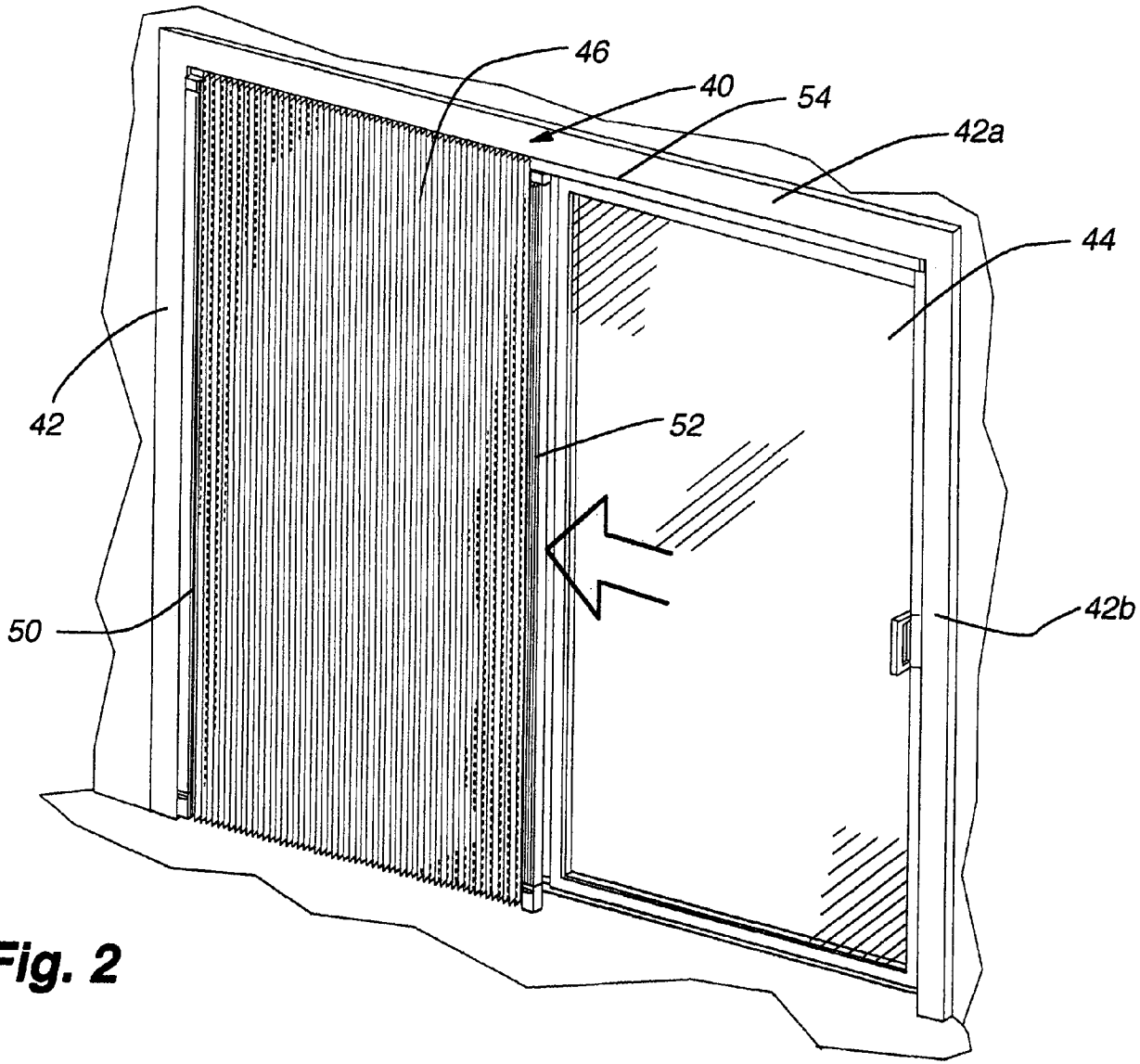
FIG. 2 is a fragmentary isometric of an architectural opening in the form of a sliding glass door having the covering of the present invention disposed therein and in a partially open position.
Figure 3:
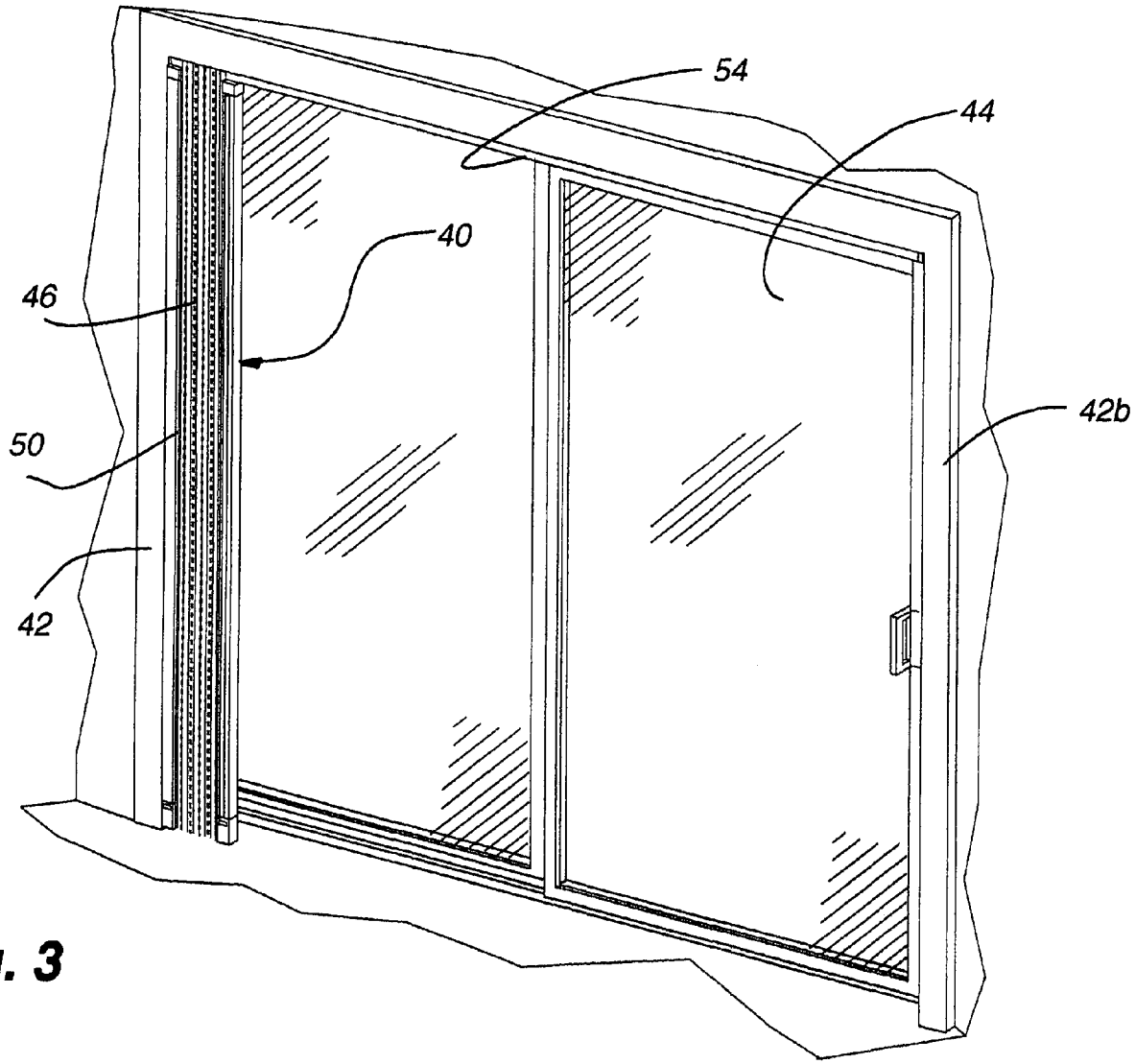
FIG. 3 is a fragmentary isometric similar to FIG. 2 with the covering in a fully retracted position.
Figure 4:
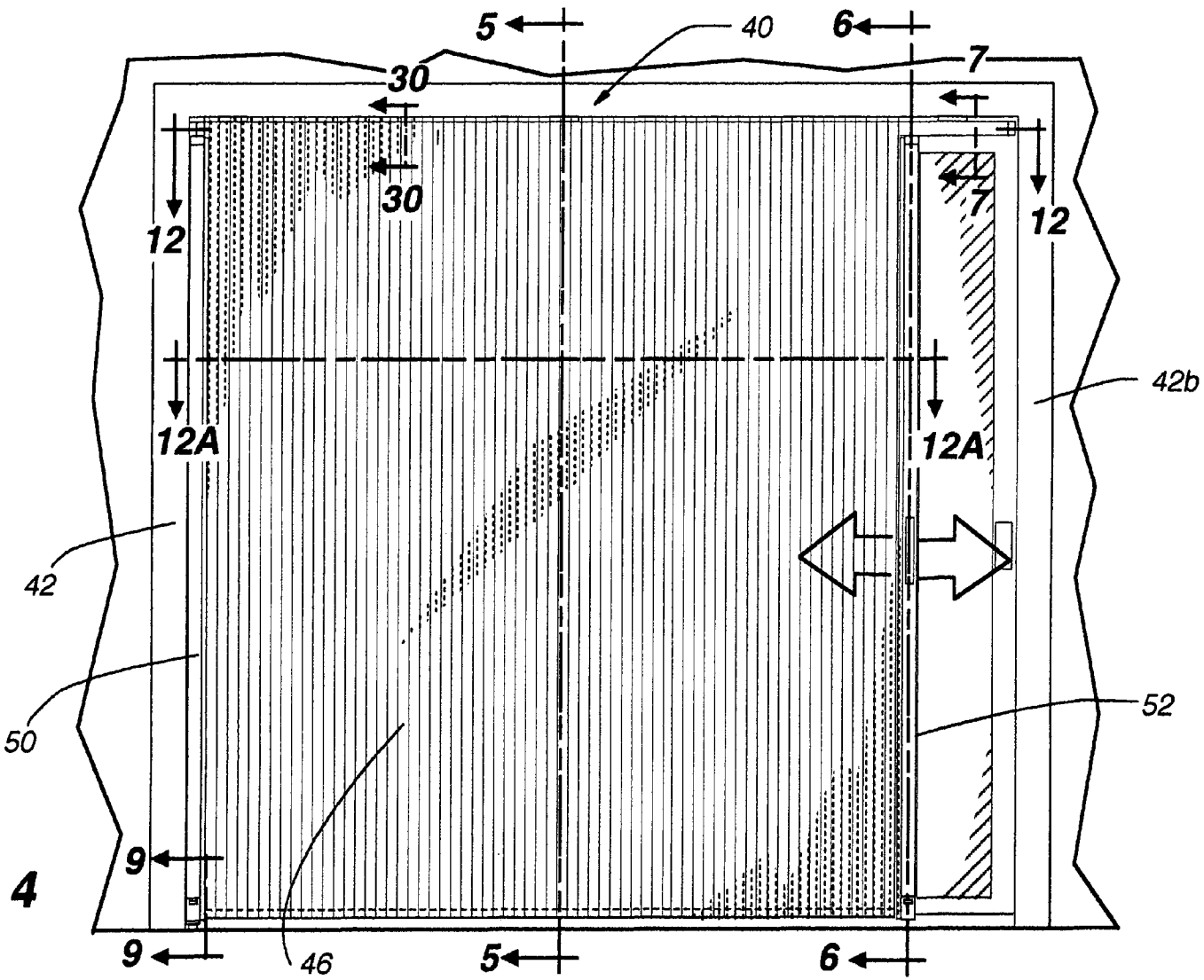
FIG. 4 is a fragmentary front elevation with the covering in a substantially fully extended position.
Figure 5:
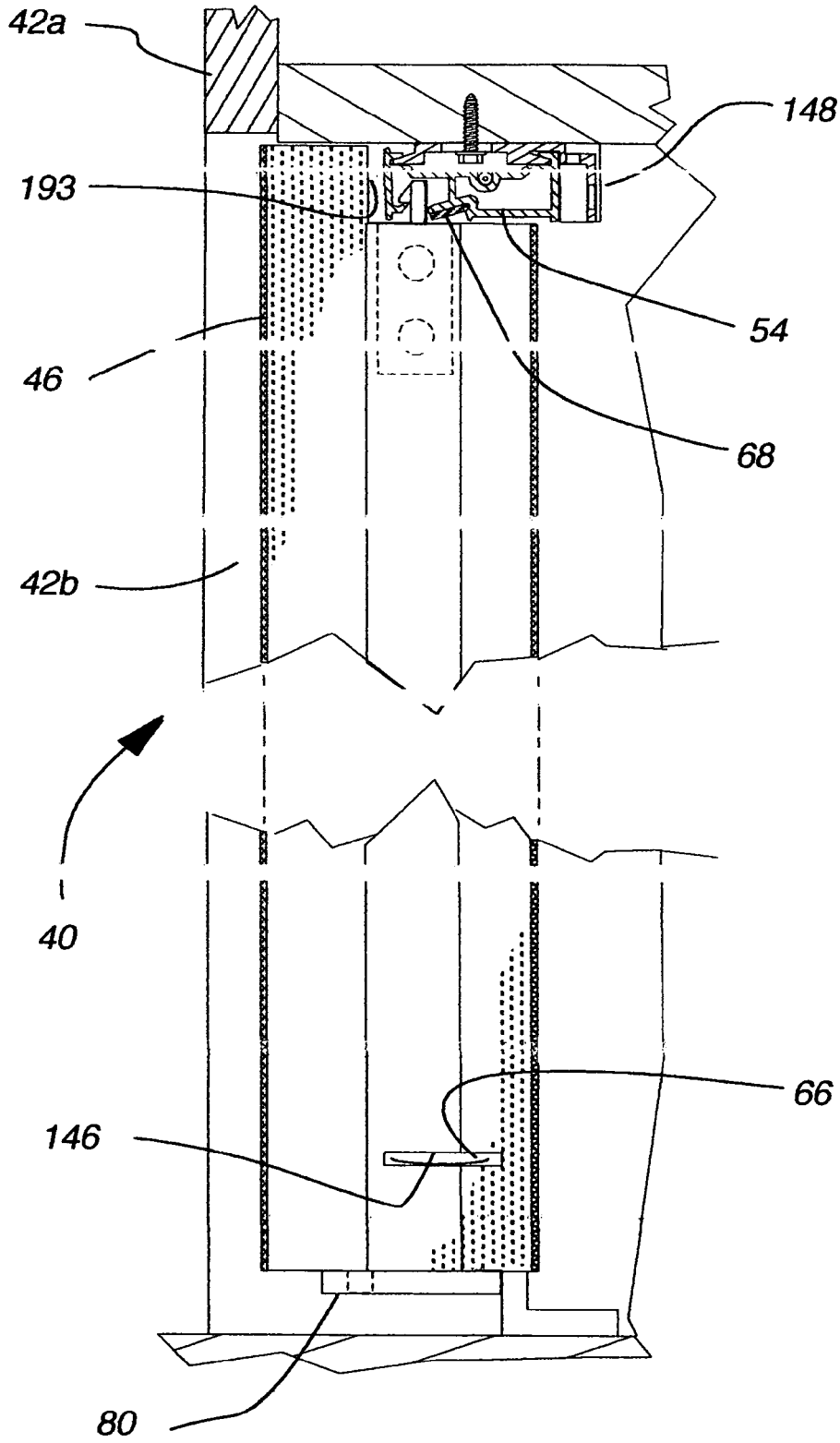
FIG. 5 is a fragmentary enlarged section taken along line 5-5 of FIG. 4.

FIGS. 1, 2 and 3 illustrate a retractable covering in accordance with the present invention mounted to a frame around an architectural opening having a sliding glass door disposed therein. The covering, as will be described in more detail hereafter, can be seen in FIG. 1 in a fully extended or closed position, in FIG. 3 in a fully retracted or open position and in FIG. 2 in a partially extended position. The covering includes an expandable fabric 38 in the form of a plurality of vertically extending transversely collapsible cells or tubes having a fixed vertical rail 50 along its left or second vertical edge 38*b* for securing the fabric to the frame of the architectural opening and a movable vertical rail 52 along its right or fourth edge 38*d* adapted to be moved horizontally within the frame between the fully retracted position of FIG. 3 and the fully extended position of FIG. 1. The top or first edge 38*a* of the fabric is suspended from a top rail mounted along the underside of a top frame member 42*a* of the architectural opening to facilitate sliding movement of the covering between the fully extended and retracted positions. The bottom or third edge 38*c* extends adjacent to a floor, which would be considered the bottom or third side 42*c* of the frame of the architectural opening.

With the description that follows, it will be appreciated the fabric for the covering could be any numerous materials with the vertical cellular fabric being illustrated simply as an example. Further, the covering could be mounted in many different types of architectural openings with the sliding glass door opening being illustrated again only as an example. As will be apparent to those skilled in the art, the covering could be adapted to extend and retract vertically as well as horizontally.

The fixed vertical rail 50 and the movable vertical rail 52 give structural rigidity to the covering inasmuch as the fabric itself is somewhat flexible. The fabric material illustrated for purposes of the present disclosure is described in more detail in U.S. Pat. No. 4,677,013, which is of common ownership with the present application and the disclosure of which is hereby incorporated by reference. The fixed and movable vertical rails are substantially identical and will be described in more detail hereafter with the movable vertical rail adapted to slide along the length of a flexible metal tape or spring steel tape which guides the movement of the movable rail and assists in maintaining a movable fixed position of the movable rail at any location between the fully extended and fully retracted positions of the covering. The flexible metal tape is longitudinally rigid and transversely flexible such as typically found on carpenter's retractable metal measuring tapes with the tape having a slight arcuate cross section. The arcuate cross-section of the spring steel assists in biasing the tape to extend in a straight line but it can be bent or flexed transversely as desired.

Figure 1A:
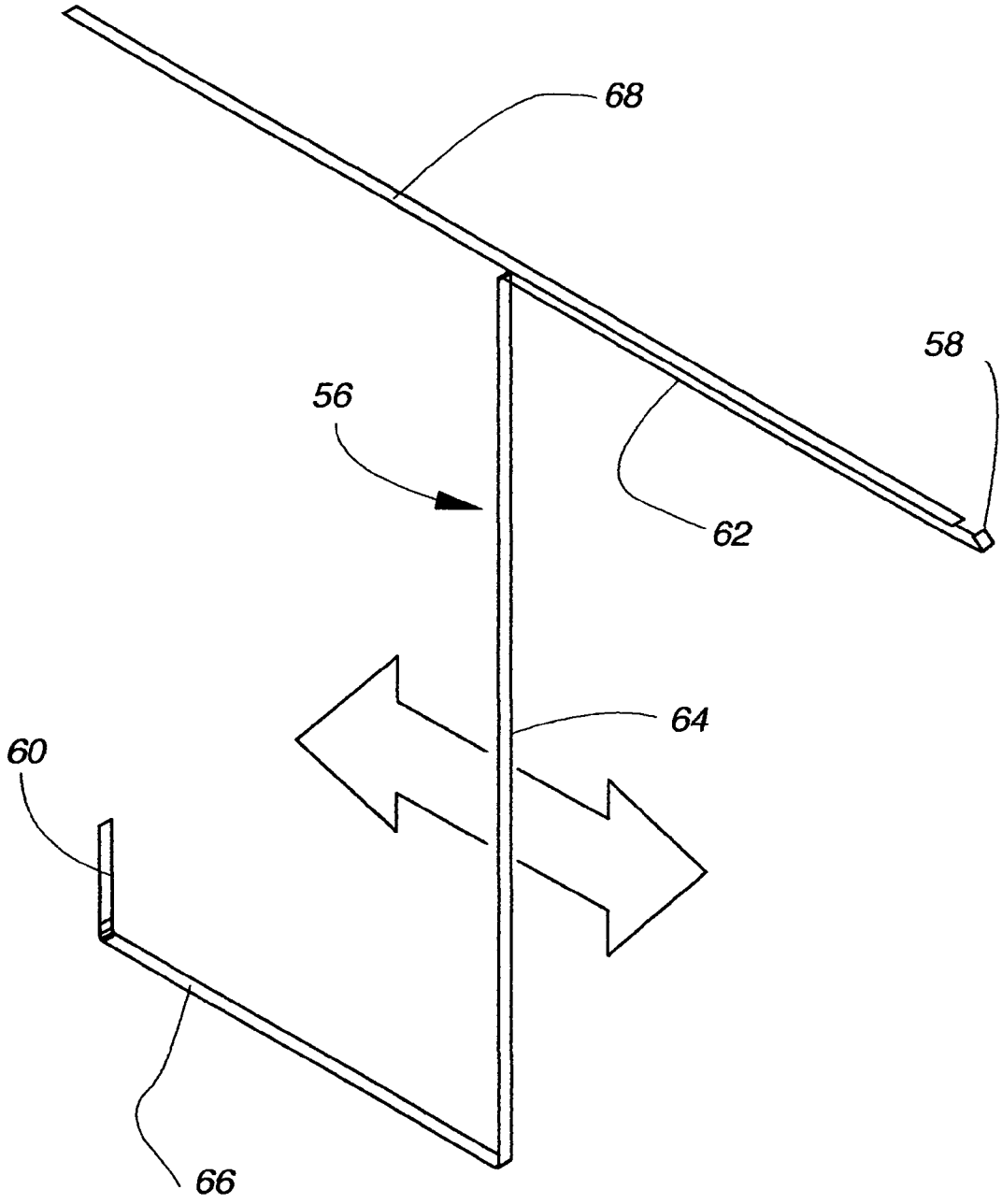
FIG. 1A is a diagrammatic view illustrating the flexible guide tape used in the covering of the present invention in combination with the magnetic strip for holding the upper horizontal run in position.
Figure 1B:
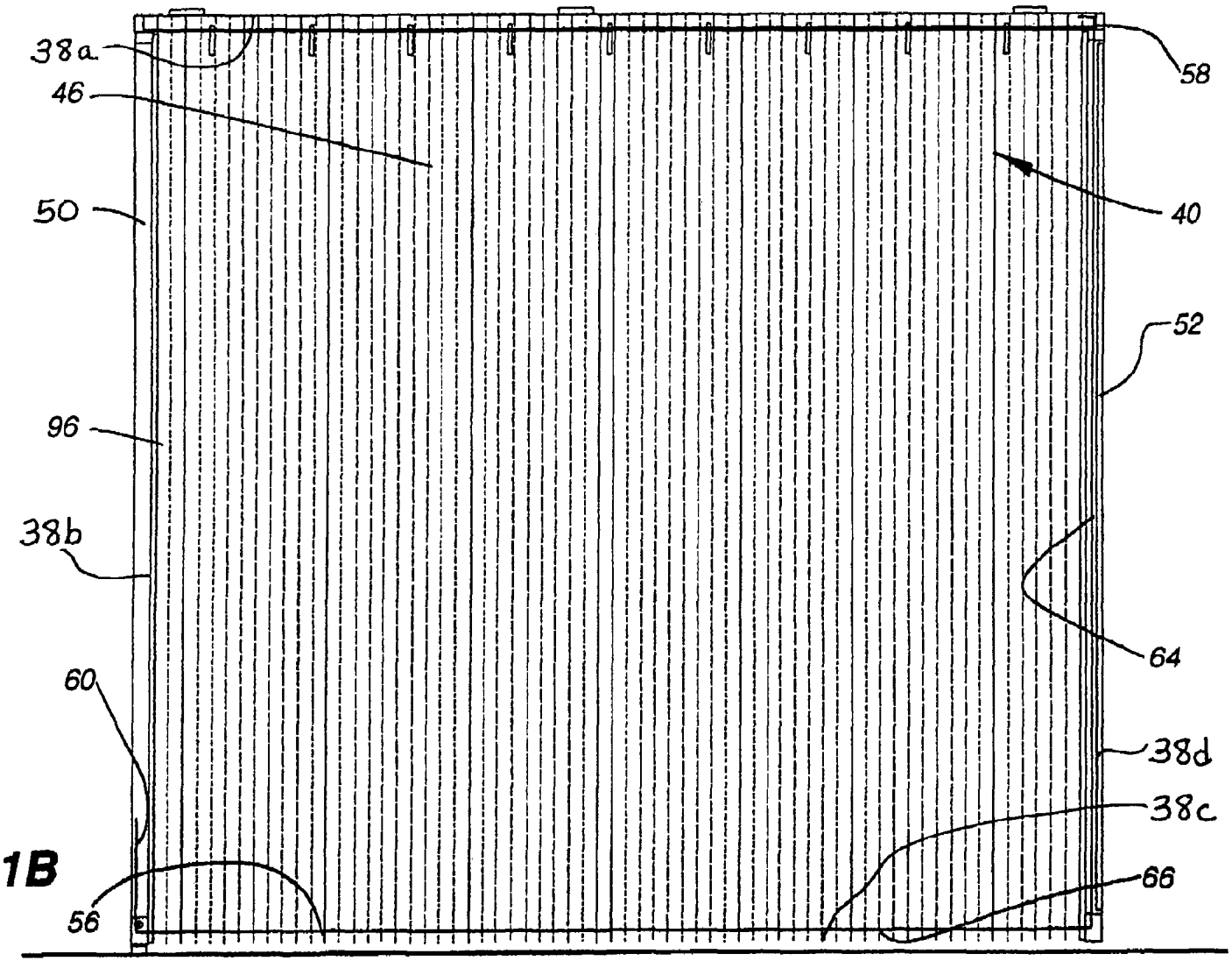
FIG. 1B is a diagrammatic front elevation illustrating the covering in an extended position and the positioning of the flexible guide tape and magnetic strip.

With reference to diagrammatic FIG. 1A, the flexible metal tape 56 can be seen to extend in a generally Z-shaped configuration from the upper right hand corner of the frame 42 for the architectural opening to the lower left-hand corner. Both the upper 58 and the lower 60 ends or tabs of the tape are fixed relative to the frame 42 for the opening. In the pass of the metal tape from one end to the other, it has a variable length upper horizontal run 62 extending to the left from its upper end 58, a vertical fixed length run 64 extending slidably through the movable rail 52 regardless of the position of the movable rail and a variable length lower horizontal run 66 extending from the lower end of the movable rail to the lower fixed end 60 of the tape. As will be described in more detail later, the upper horizontal run 62 of the tape is magnetically but releasably attracted to a magnetic tape 68 extending along the upper edge 42*a* of the architectural opening. It can be appreciated from reference to FIG. 1A that as the movable rail is moved to the right or left between extended and retracted positions, the length of the upper 62 and lower 66 horizontal runs of metal tape will change oppositely but in corresponding amounts. In other words, as the upper horizontal run becomes shorter as the movable rail is moved toward its extended position of FIG. 1B, the lower horizontal run becomes longer in an equivalent amount. As the movable rail is moved toward the retracted position shown in FIG. 3, however, the upper horizontal run becomes longer and the lower horizontal run becomes shorter in an equivalent amount. Obviously, the overall length of the flexible metal tape does not change, nor does the length of the vertical run 64, and the tape is allowed to slide vertically within the movable rail as will be described later.

Figure 1C:
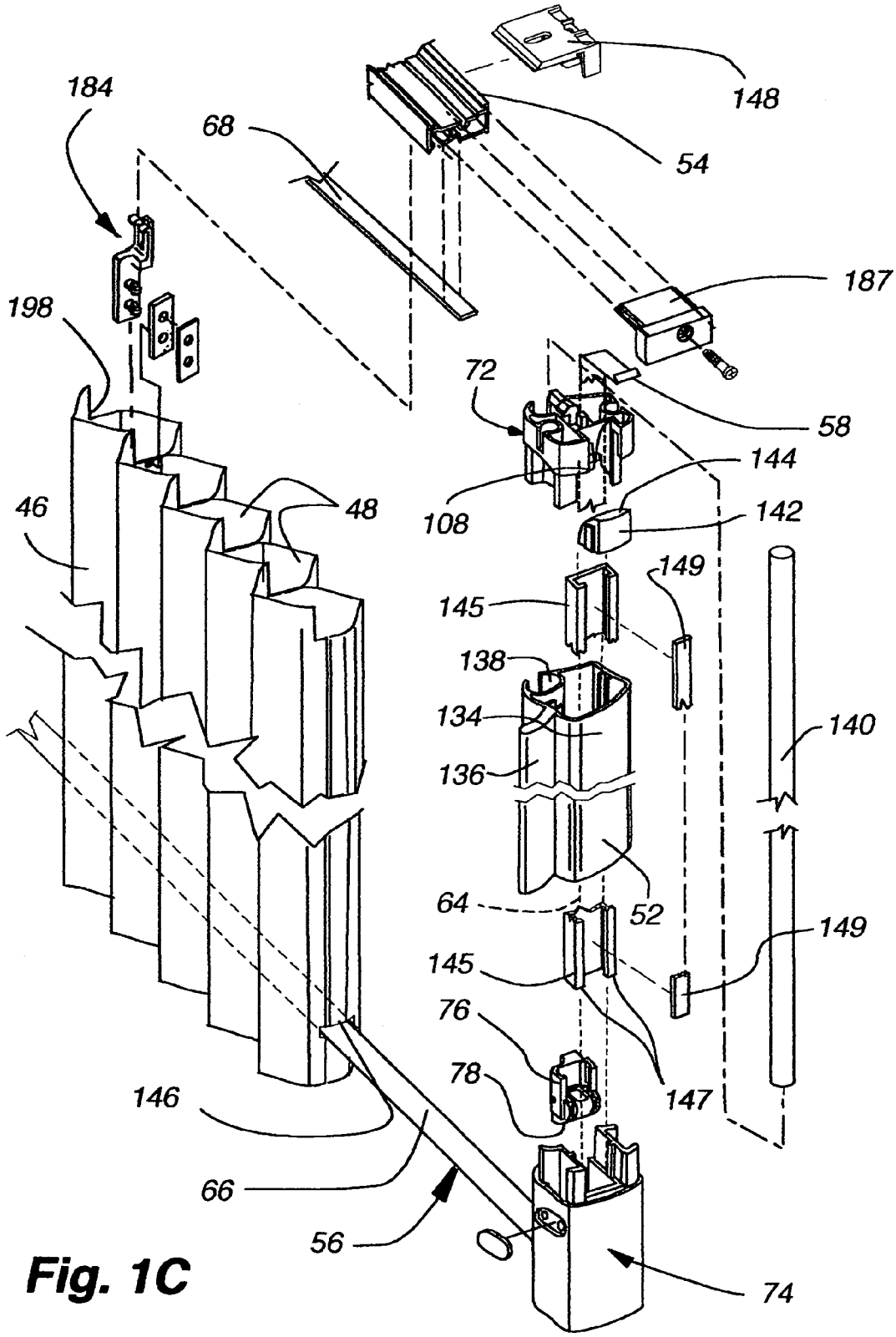
FIG. 1C is an exploded isometric showing the vertical movable rail of the covering of the present invention.
Figure 1D:
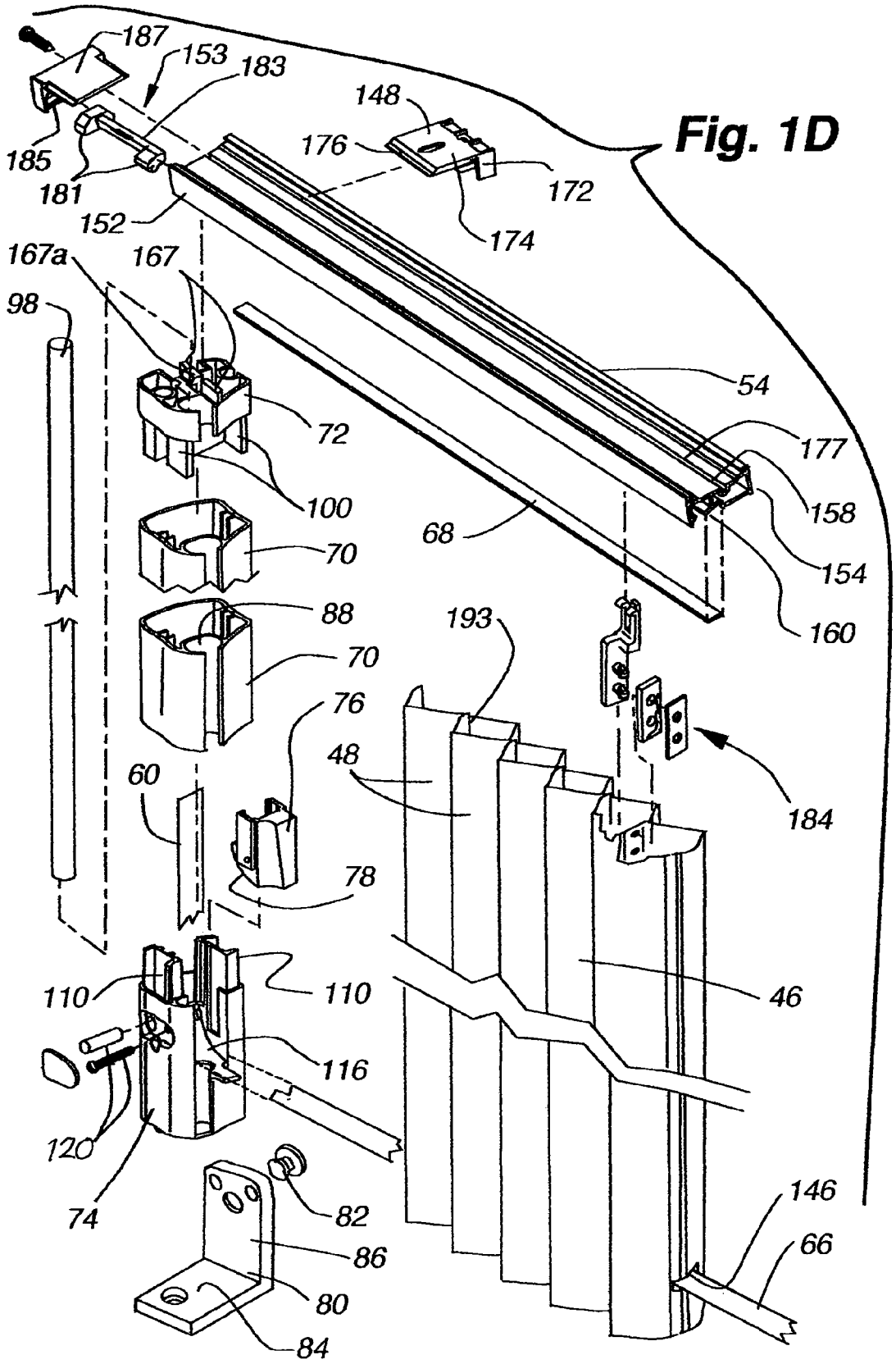
FIG. 1D is an exploded isometric showing the fixed vertical rail of the covering of the present invention.

Referencing FIG. 1D, the fixed vertical rail 50 can be seen to include a main somewhat rigid tubular body 70, preferably extruded from a suitable metal or plastic material, a top end plug 72 and a bottom end plug 74. An insert 76 having a convex ramp surface 78 is adapted to be removably connected in the bottom plug to secure the lower end of the metal tape 56 in the bottom plug as will be described later. An L-shaped anchor bracket 80 having a connector pin 82 secures the bottom plug 74 of the fixed rail 50 to the frame of the architectural opening either by anchoring a lower horizontal leg 84 of the bracket or a vertical leg 86 of the bracket to the frame as required. The connector pin secures the plug to the vertical leg of the bracket so that the plug is in turn secured relative to the frame of the opening. The top plug 72 is anchored to the top rail 56 as will be described hereafter.

Figure 25:
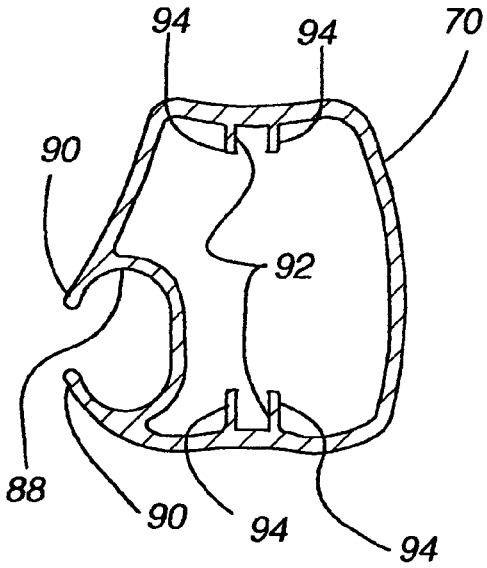
FIG. 25 is a top plan view of the fixed vertical rail of the covering of the invention.
Figure 25A:
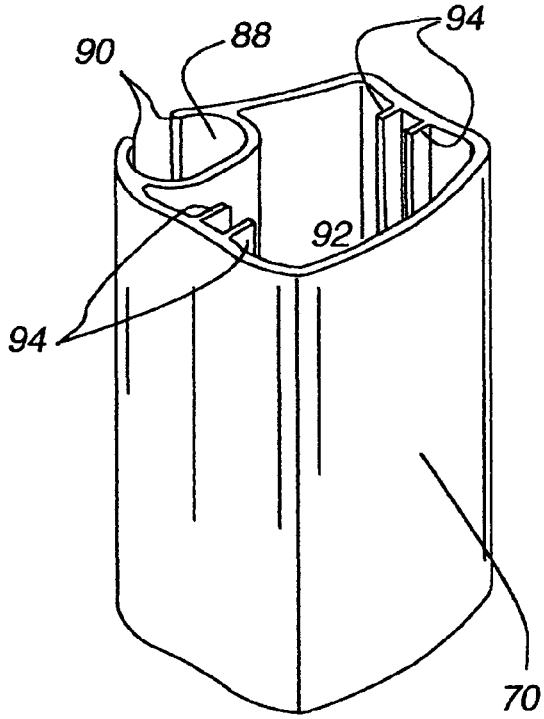
FIG. 25A is an isometric of the rail of FIG. 25.
Figure 26:
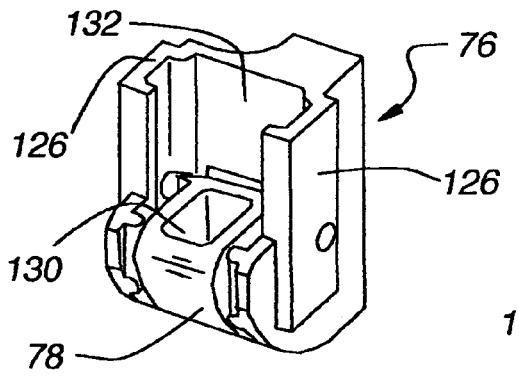
FIG. 26 is an isometric looking downwardly on the insert used with the top and bottom plug of the vertical rails of the covering.
Figure 27:
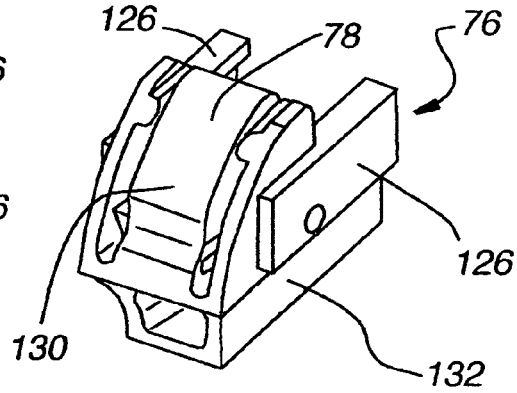
FIG. 27 is an isometric looking at the bottom of the insert of FIG. 26.
Figure 28:
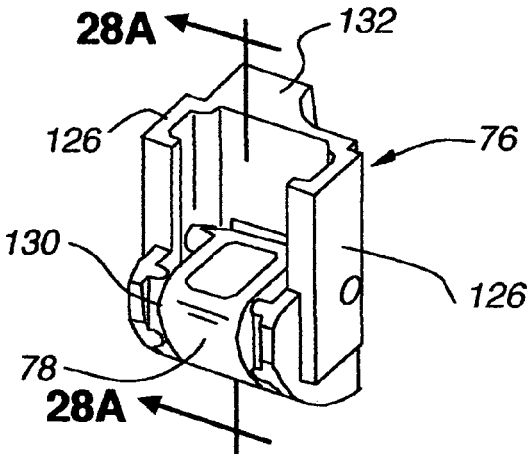
FIG. 28 is an isometric looking downwardly on the plug from the opposite side as FIG. 22.
Figure 29:
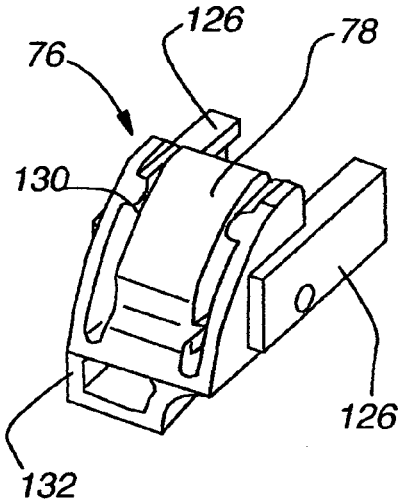
FIG. 29 is an isometric looking upwardly at the bottom from the opposite side as FIG. 27.
Figure 28B:
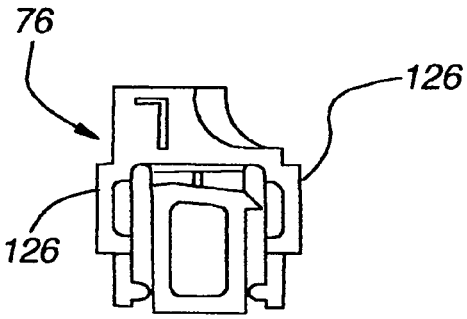
FIG. 28B is a top plan view of the insert as shown in FIG. 28.
Figure 28A:
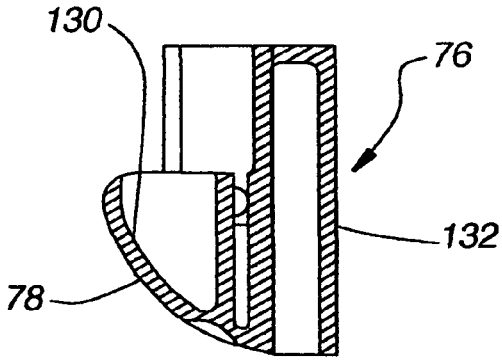
FIG. 28A is a section taken along line 28A-28A of FIG. 28.
Figure 30:
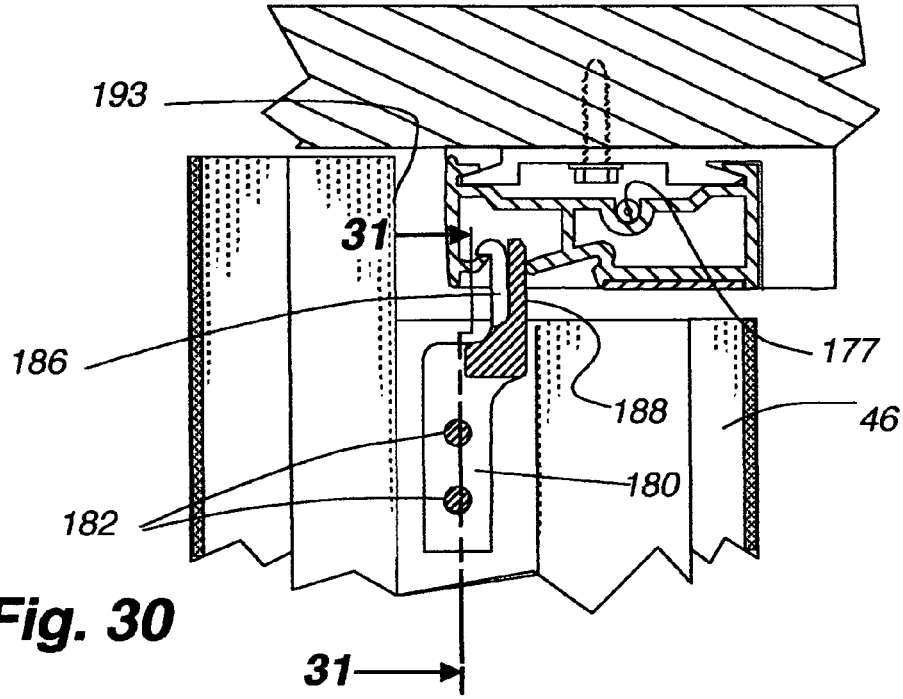
FIG. 30 is an enlarged fragmentary section taken along line 30-30 of FIG. 4.
Figure 31:
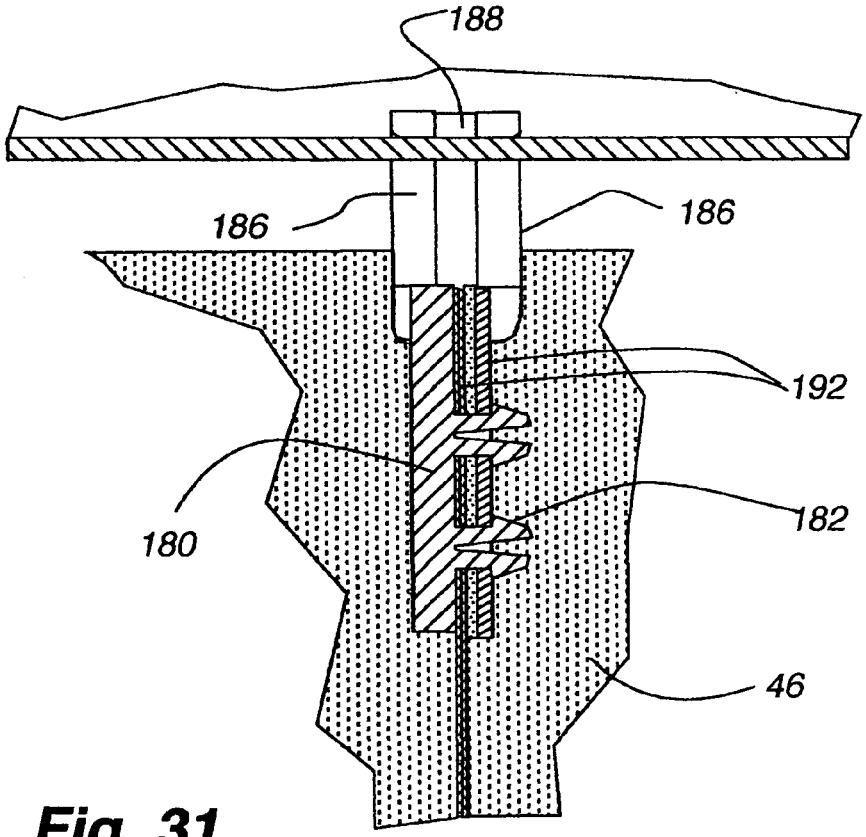
FIG. 31 is an enlarged section taken along line 31-31 of FIG. 30.
Figure 33:
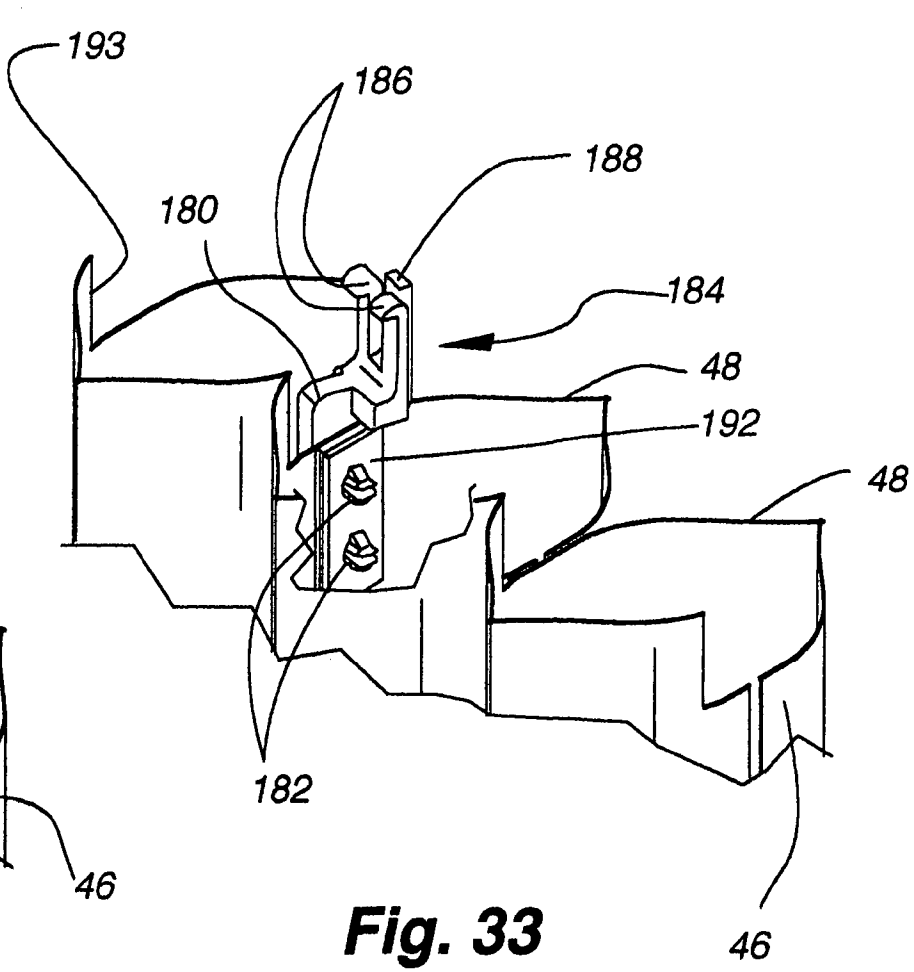
FIG. 33 is a fragmentary isometric similar to FIG. 32 with the carrier secured to the top edge of the fabric.
Figure 32:
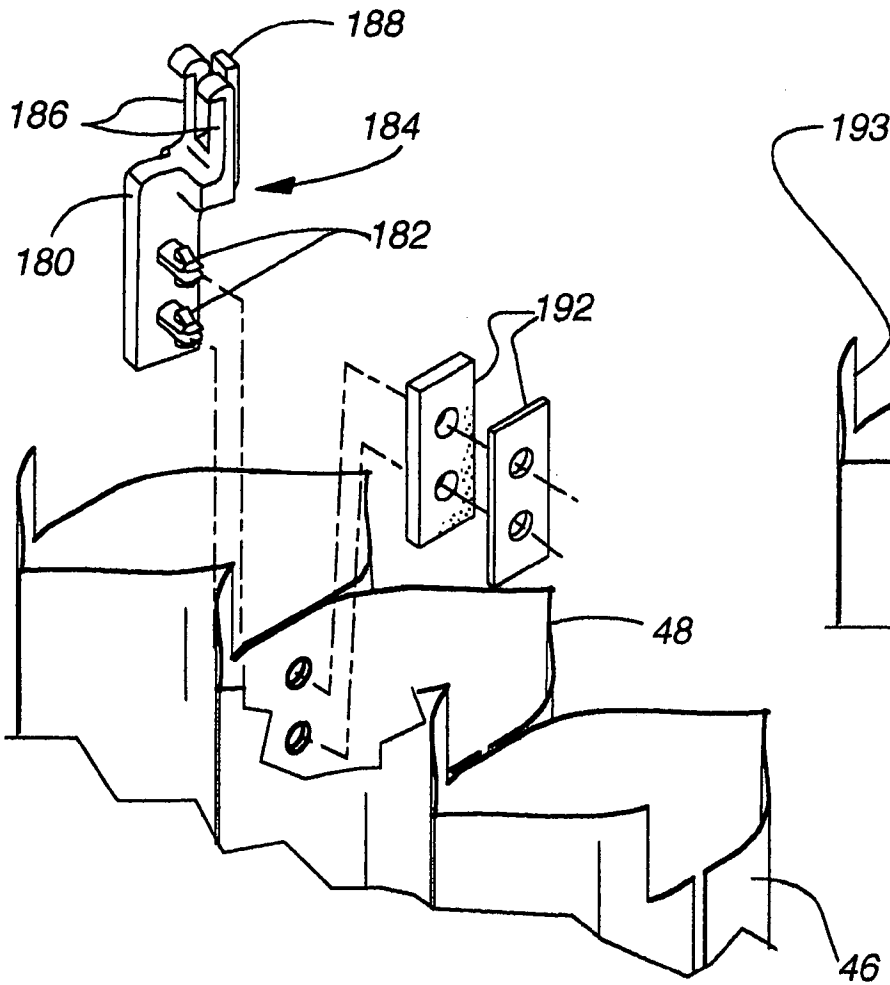
FIG. 32 is an exploded isometric illustrating the connection of a carrier to the top edge of the covering fabric.

The tubular main body 70 is seen best in FIGS. 25 and 25A to comprise an enclosed body of generally rectangular configuration having an ovular longitudinal recess 88 opening through one side of the body with a pair of confronting lips 90. On front and rear walls of the main body, vertical opposed channels 92 are provided by spaced arms 94. The ovular recess 88 opening through the side of the main body is adapted to receive and retain the left or fixed edge 96 of the fabric 46 by inserting the fabric into the recess and inserting a retention rod 98 (FIG. 1D) into the recess so that the fabric is securely connected to the main body. When the fabric is cellular as shown, the rod 98 can be inserted through the endmost cell. For other fabrics, hems can be made in the fabric to define a loop of fabric in which the rod can be inserted. This connection is possibly best illustrated in FIG. 12A.

Figure 16:
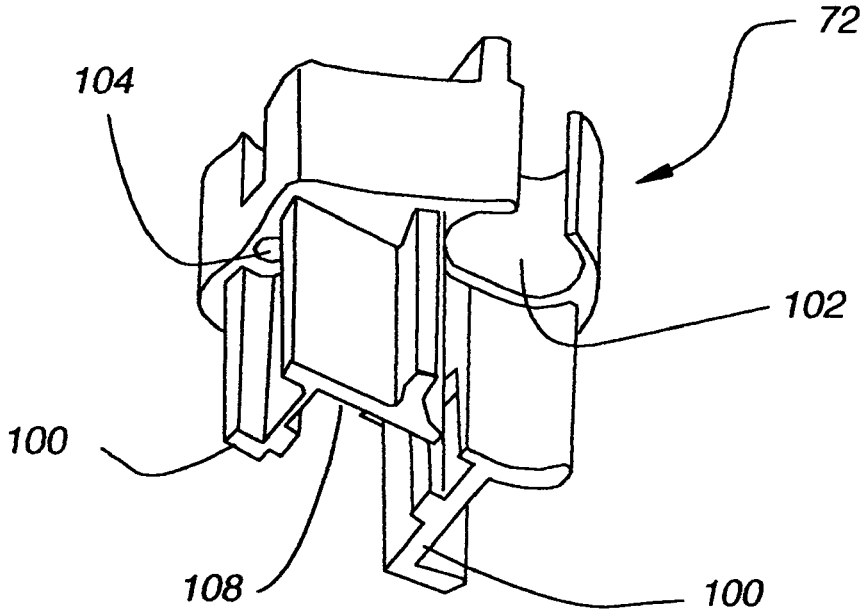
FIG. 16 is an isometric looking upwardly at the bottom of the upper plug for the vertical rails of the present invention.
Figure 17:
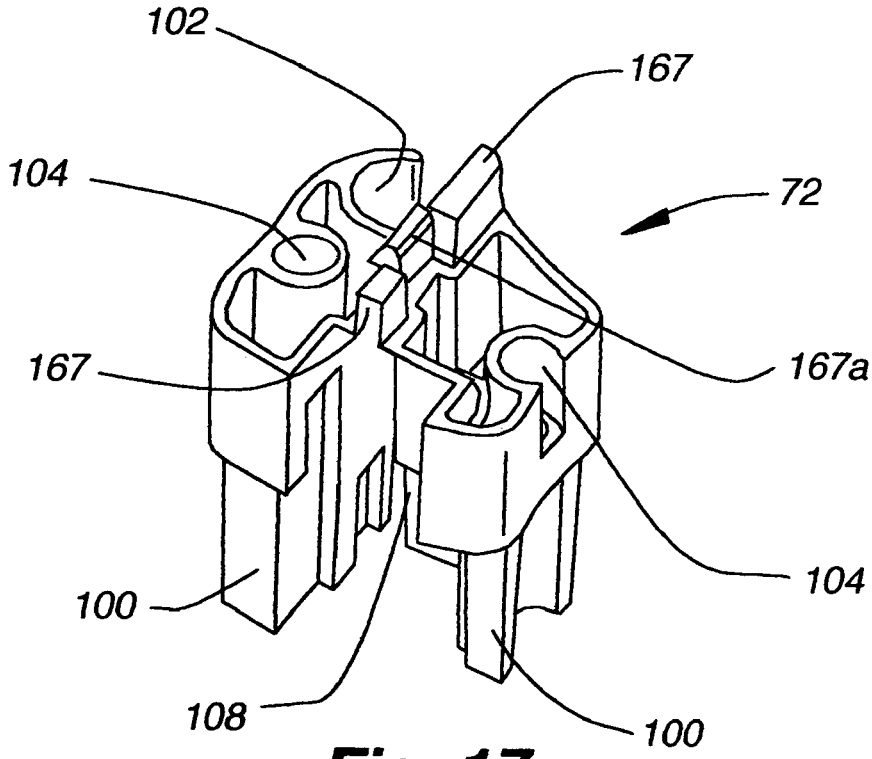
FIG. 17 is an isometric similar to FIG. 16 looking downwardly on the upper plug for the rails.

The top plug 72 as seen in FIGS. 16, 17, and 1D is a modular body having depending legs 100 adapted to fit within the open top end of the tubular main body 70 of a vertical rail with the legs configured to frictionally grip or fit snuggly in the tubular body so as to remain fixed therein. It has a complementary ovular-shaped recess 102 for alignment with the recess 88 in the main body so the fabric 46 can extend into the top plug and be secured therein in the same manner it is secured in the main body. A pair of spaced vertical screw holes 104 extend through the top plug for receipt of screw-type fasteners (not shown) having threads that can be received in the open upper ends of the opposed channels 92 in the main body to assist in positively retaining the plug in the body. The top plug has a concave ramp 108 that is not used or needed in the fixed vertical rail 50 but does have a use in the movable vertical rail 52 as will be discussed later. The plug 72 of course gives a finished look to the top of the vertical rail.

Figure 18:
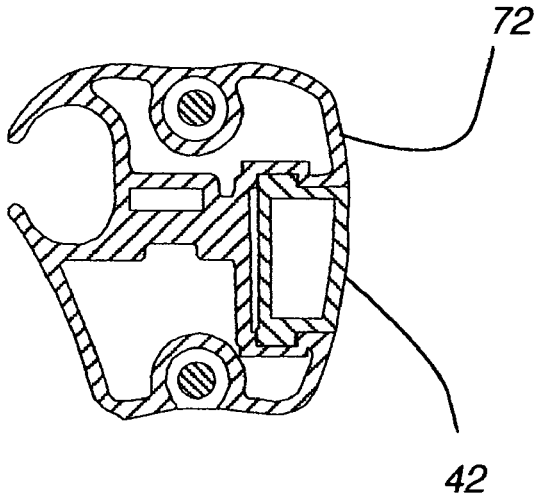
FIG. 18 is a horizontal section through the top end plug.

The bottom plug 74 has a pair of upstanding legs 110 adapted to be frictionally or snuggly received in the open bottom end of the main body of a vertical rail 50 or 52 with the bottom plug probably seen best in FIGS. 20-23 and 1D. Vertical passages 112 are also provided through the bottom plug to receive threaded fasteners (not shown) to secure the bottom plug in the open bottom end of the main body 70 with the threaded fasteners being threaded into the lower ends of the opposed channels 92 in the main body. The bottom plug has an arcuate, concave ramp 116 opening through a notched side thereof with the ramp being designed to guide the flexible metal tape 56 from its lower horizontal run 66 into the upwardly bent lower end 60 of the tape in the fixed vertical rail 50 and as will be seen later upwardly through the tubular body of the movable vertical rail 52. Spaced vertical fingers 118 are provided on the legs of the bottom plug to guide the upturned end of the flexible tape once it is inserted into the bottom plug. The connection of the tape to the plug in the fixed vertical rail 50 will be described later and is accomplished with the use of two connection pins 120 that are inserted laterally through side-by-side openings 122 in the bottom plug seen best in FIGS. 1D, 18, and 20.

The insert 76 used to secure the bottom end of the flexible metal tape 56 to the bottom plug 74 of the fixed rail 50 is seen in FIGS. 1D, 24-27, 26-29, 28A and 28B. The insert can be seen to have the complementary convex ramp 78 to the concave ramp 116 on the bottom plug and opposed channels 126 adapted to be dropped vertically into the bottom plug so that the convex ramp of the insert is in face-to-face but slightly spaced relationship from the concave ramp of the bottom plug. The flexible tape extends in the gap between the convex and concave ramps with the ramps forcing the flexible tape to curve between the lower horizontal run 66 of the tape and the vertical tab at the bottom end 60 of the tape. With reference to FIG. 15B, the tape is pinched in the bottom plug through the use of the two pins 120 inserted through the side-by-side openings 122 with one pin being received in a groove 128 formed in the concave ramp surface of the bottom plug and the second pin in a space between a flexible segment 130 of the insert 76 and a main body 132 of the insert so that the second pin urges the flexible segment in a direction to compress the flexible tape between the convex and concave surfaces and against the first pin. The tape is thereby fixed at its lower end in the bottom plug and since the bottom plug is secured to the frame 42 of the window covering with the bracket 80, the lower end of the tape is fixed relative to the frame of the architectural opening.

Figure 6:
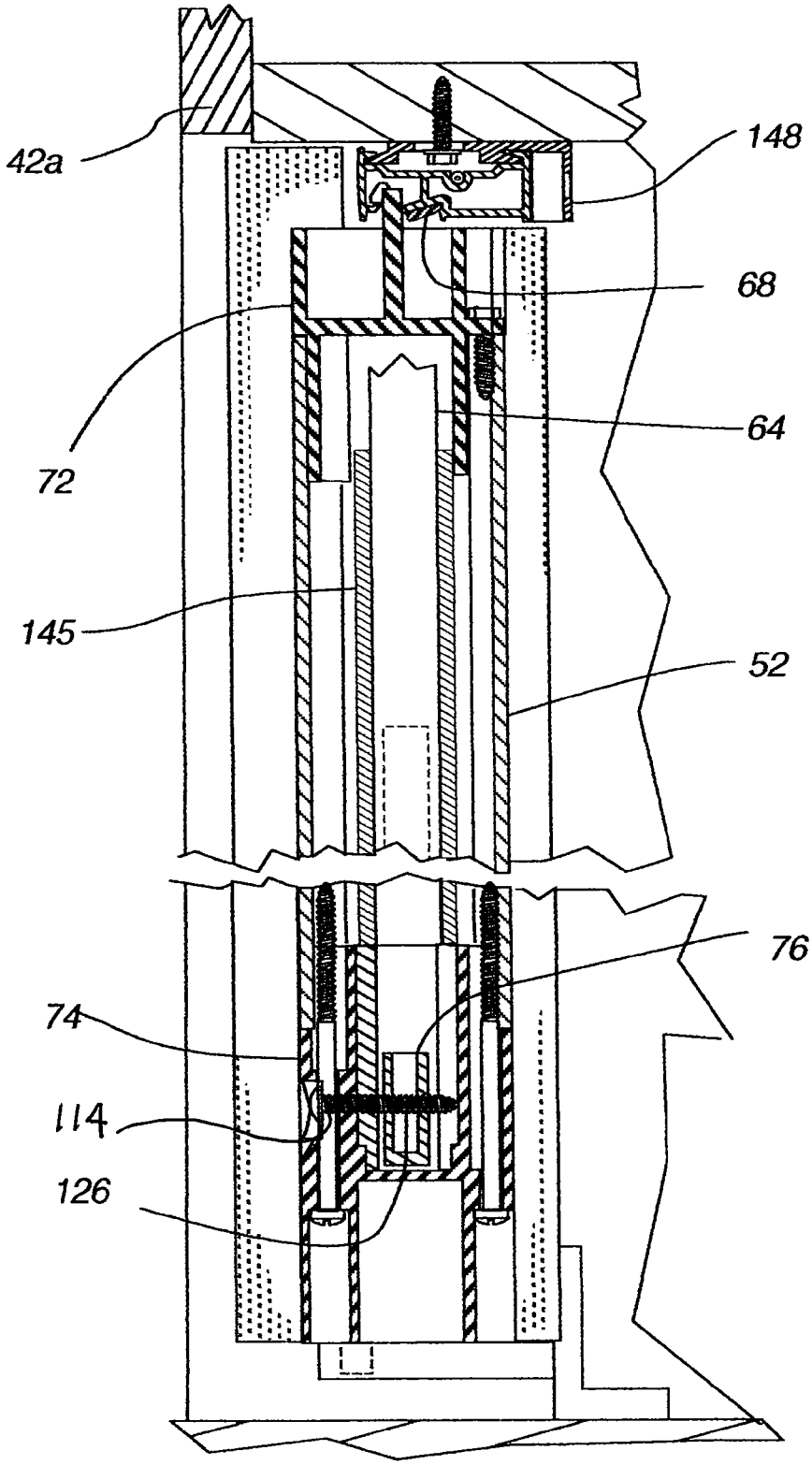
FIG. 6 is an enlarged fragmentary section taken along line 6-6 of FIG. 4.

The movable rail 52 is probably seen best in FIG. 1C to include a tubular main body 134 identical to the main body of the fixed rail 50 except that a vertically extending handle 136 protrudes forwardly off the front face of the main body so that an operator of the covering can easily grip and move the movable rail between extended and retracted positions of the covering. The main body 134 of the movable rail also has an open longitudinal ovular recess 138 in which the adjacent edge of the fabric 46 can be inserted and retained with a retention rod 140 as with the opposite vertical edge of the fabric in the fixed vertical rail. The main body of the vertical movable rail is also hollow so the vertical run 64 of the flexible tape 56 can extend through and slide therewithin. The bottom plug 74 for the movable rail, which is identical to the bottom plug on the fixed rail, has upstanding legs 110 that are inserted into the open bottom end of the main body 134 and can be secured therein with fasteners 114 (FIG. 6) extending through the vertical holes 112 in the bottom plug seen best in FIG. 21 with the fasteners extending into the opposed channels 92 in the main body to secure the bottom plug in the main body. An insert 76 identical to that on the bottom plug of the fixed rail is also positioned in the bottom plug on the movable rail and again having a convex arcuate ramp 78 for guidance of the flexible tape 56 as it traverses between its lower horizontal run 66 and its vertical run 64. In the bottom end of the movable rail, however, connection pins are not inserted into the bottom plug as it is desirous that the flexible tape slide through the gap between the convex and concave ramps as the movable rail is moved horizontally between extended and retracted positions.

Figure 18A:
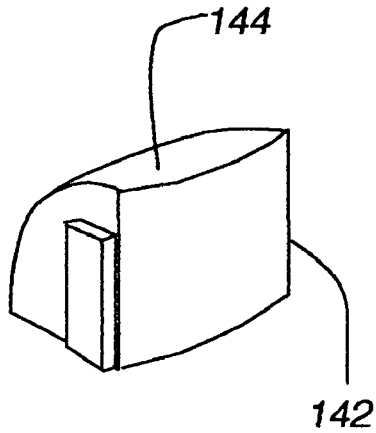
FIG. 18A is an isometric of the insert for the top end plug.
Figure 19:
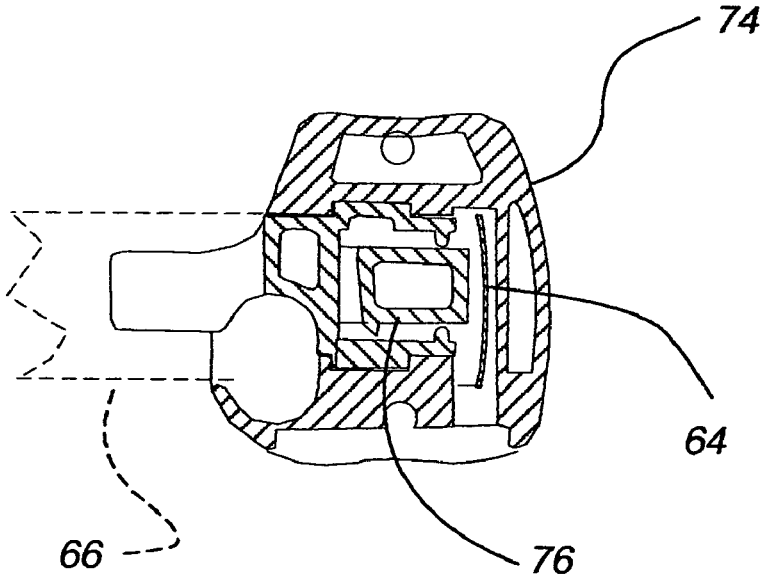
FIG. 19 is a horizontal section through the bottom end plug.
Figure 20:
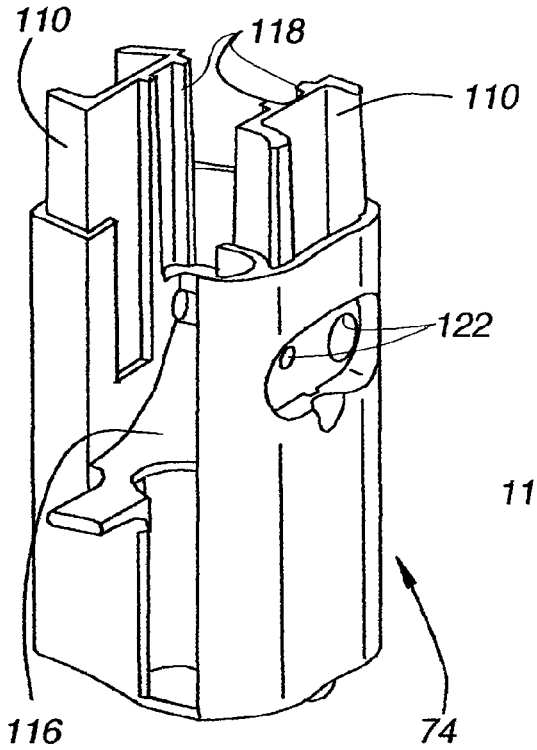
FIG. 20 is an isometric looking downwardly at the bottom end plug.
Figure 21:
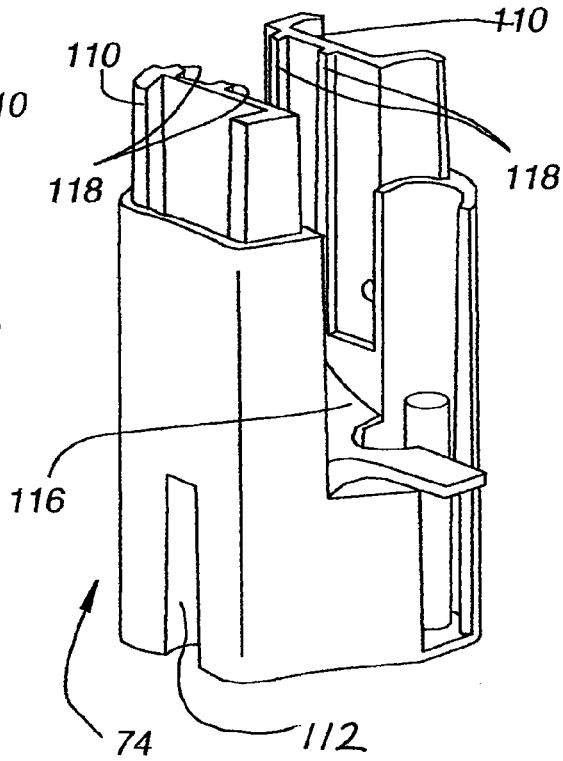
FIG. 21 is an isometric looking downwardly at the plug of FIG. 20 from a different angle.
Figure 22:
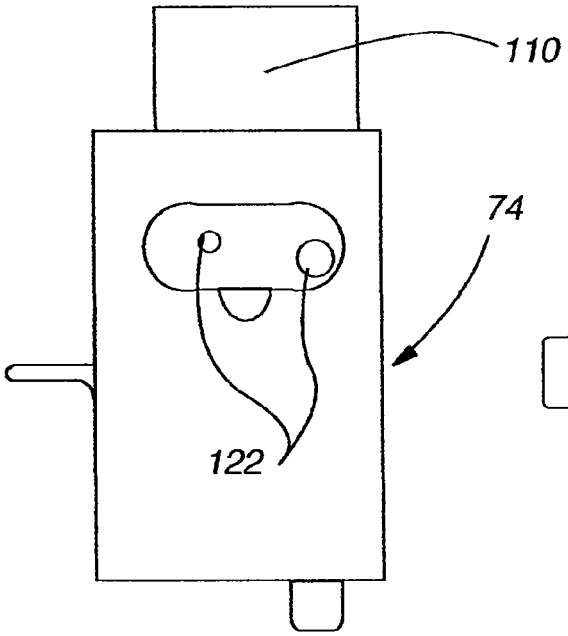
FIG. 22 is a side elevation of the plug of FIG. 20.
Figure 23:
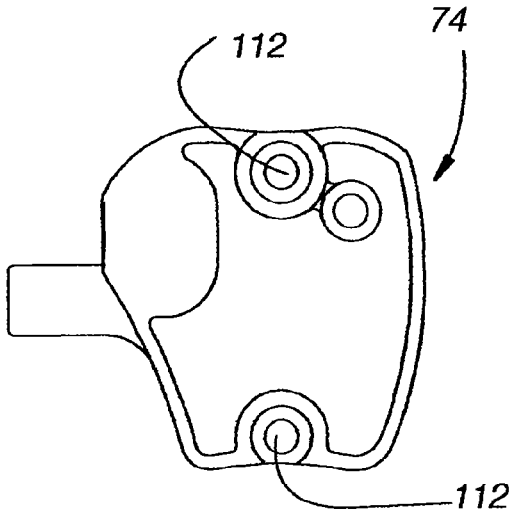
FIG. 23 is a bottom plan view of the plug of FIG. 20.
Figure 24:
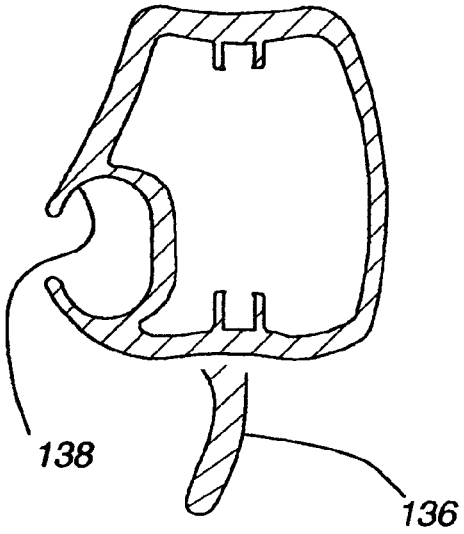
FIG. 24 is a top plan view of the vertical movable rail of the covering of the present invention.
Figure 24A:
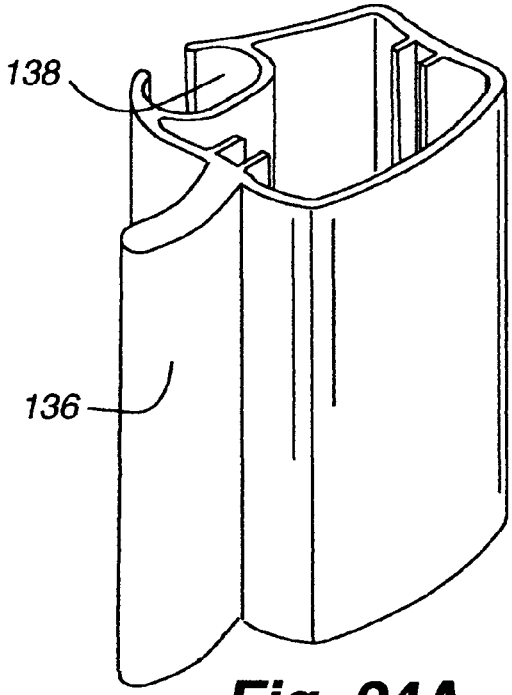
FIG. 24A is an isometric of the vertical movable rail of FIG. 24.

The movable rail 52 has a top plug 72 identical to that on the fixed rail 50 with the top plug again being inserted into and secured to the main body of the movable rail identically to the vertical fixed rail. A small insert 142, best seen in FIGS. 1C and 18A, is positioned within the top plug with the insert having a convex arcuate ramp 144 complementary with the concave ramp 108 on the top plug and defining a gap with the concave surface to slidably receive the flexible tape 56. The gap defines a passage for bending or curving the tape so that it passes between the vertical run 64 in the main body 134 of the movable rail and the upper horizontal run 62 before the top end 58 of the tape is anchored to the top rail 54 as will be explained hereafter. It should also be noted in FIGS. 1C and 1D that a horizontal rectangular slot 146 is formed through the fabric 46 adjacent to the bottom edge thereof with the slot slidably receiving the lower horizontal run 66 of the flexible tape. Accordingly, as the covering is moved between the extended and retracted positions, the lower edge of the fabric can slide along the metal tape.

Figure 12:
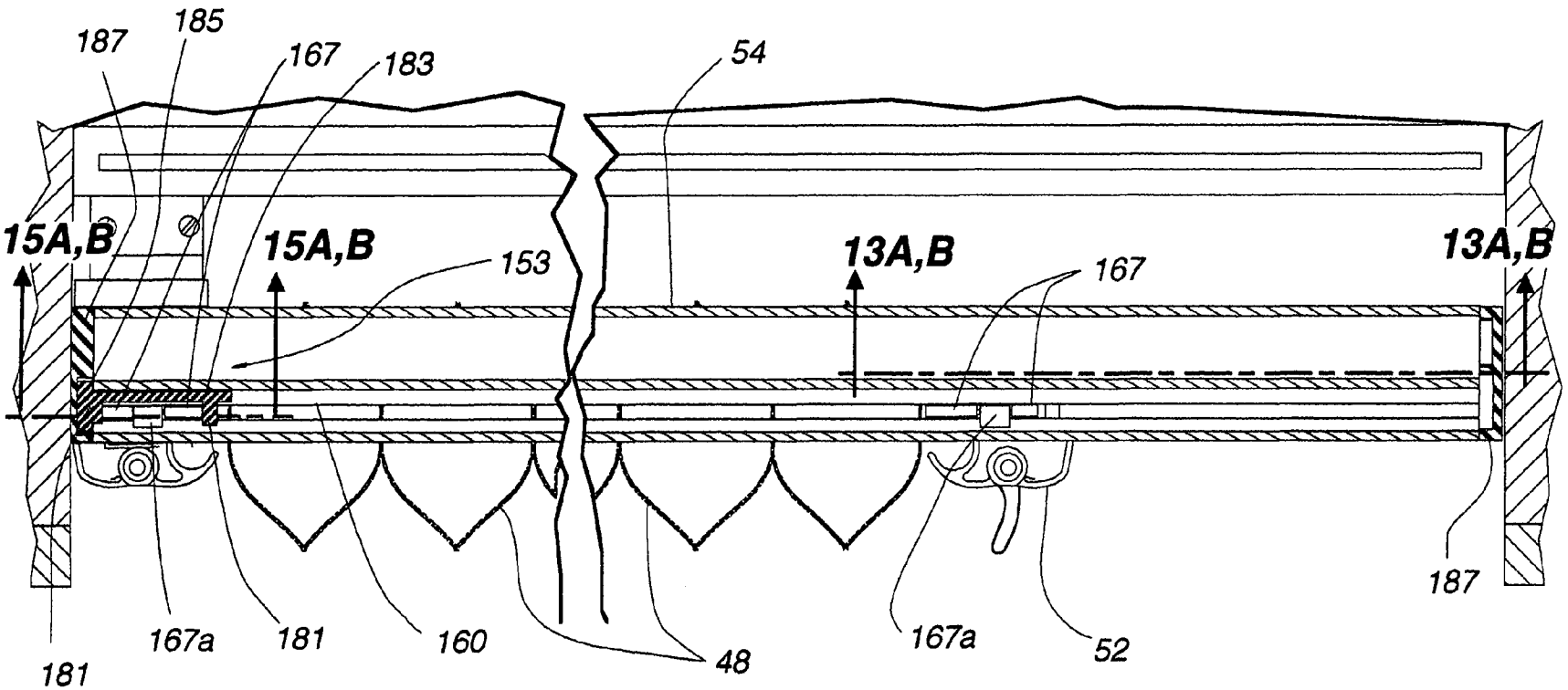
FIG. 12 is an enlarged fragmentary section taken along line 12-12 of FIG. 4.
Figure 12A:
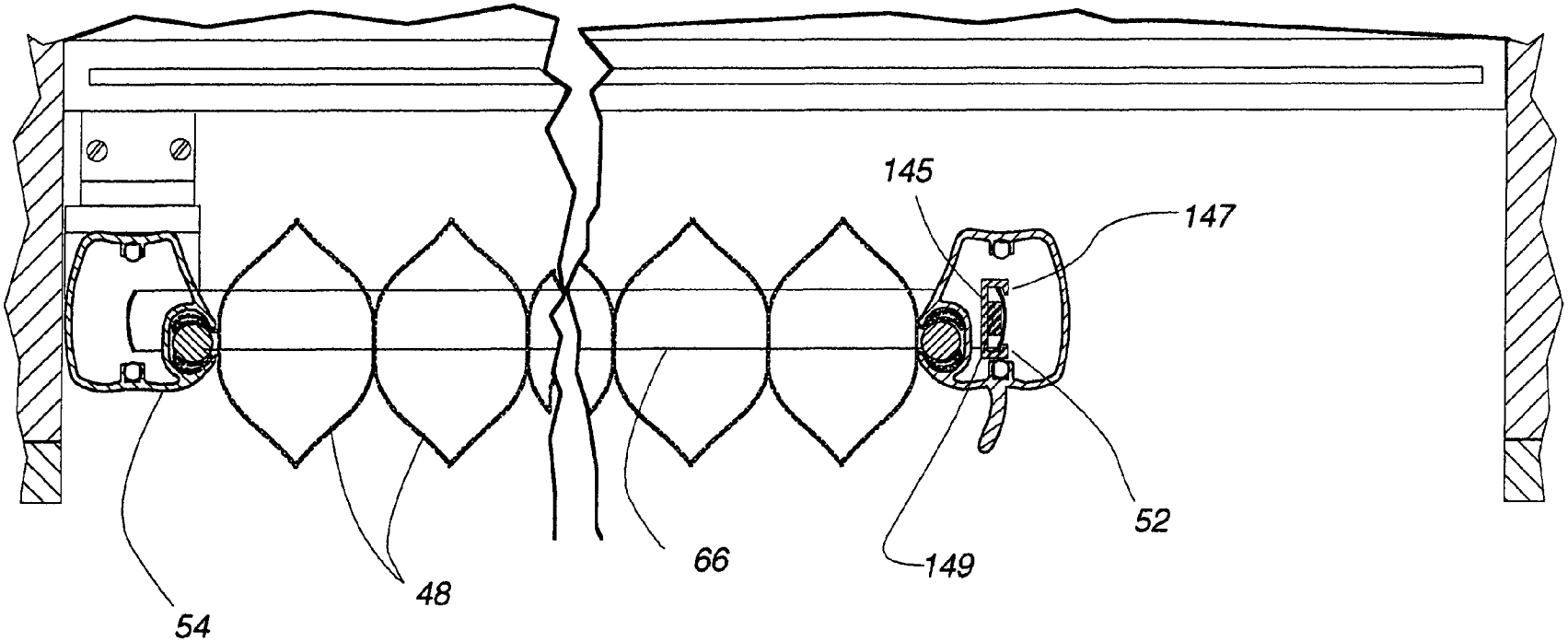
FIG. 12A is an enlarged fragmentary section taken along line 12A-12A of FIG. 4.

As possibly best appreciated by reference to FIGS. 1C and 12A, a vertically extending slide channel 145 of generally U-shaped configuration having overhanging lips 147 is anchored at its upper and lower ends in the top 72 and bottom 74 plugs within complementary channels in the top and bottom plugs. The slide channel is adapted to receive and slidably confine the flexible metal tape 56 along its vertical run 64. Over a predetermined length of the slide channel, a flat magnetic tape 149 is secured to the base of the slide channel so as to remain in engagement with the metal tape 56 sliding over the magnetic tape 149 during operation of the covering. The magnetic tape, of course, attracts the flexible metal tape and will releasably hold it in position thereby assisting in retaining the shade in any position within the architectural opening. Of course, manual force on the movable vertical rail 52 moving it between extended and retracted positions overcomes the magnetic attraction of the magnetic tape to the flexible metal tape so that the flexible metal tape is free to slide within the movable vertical rail during operation of the covering. The length of the magnetic tape is determined by the desired amount of resistance to movement of the covering and obviously the longer the magnetic tape the more resistance to sliding movement of the flexible metal tape through the movable rail and the shorter the magnetic tape the less resistance. A magnetic tape of approximately one-third the height of the movable rail 52 has been found to be desirable even though this is a personal preference.

Figure 7:
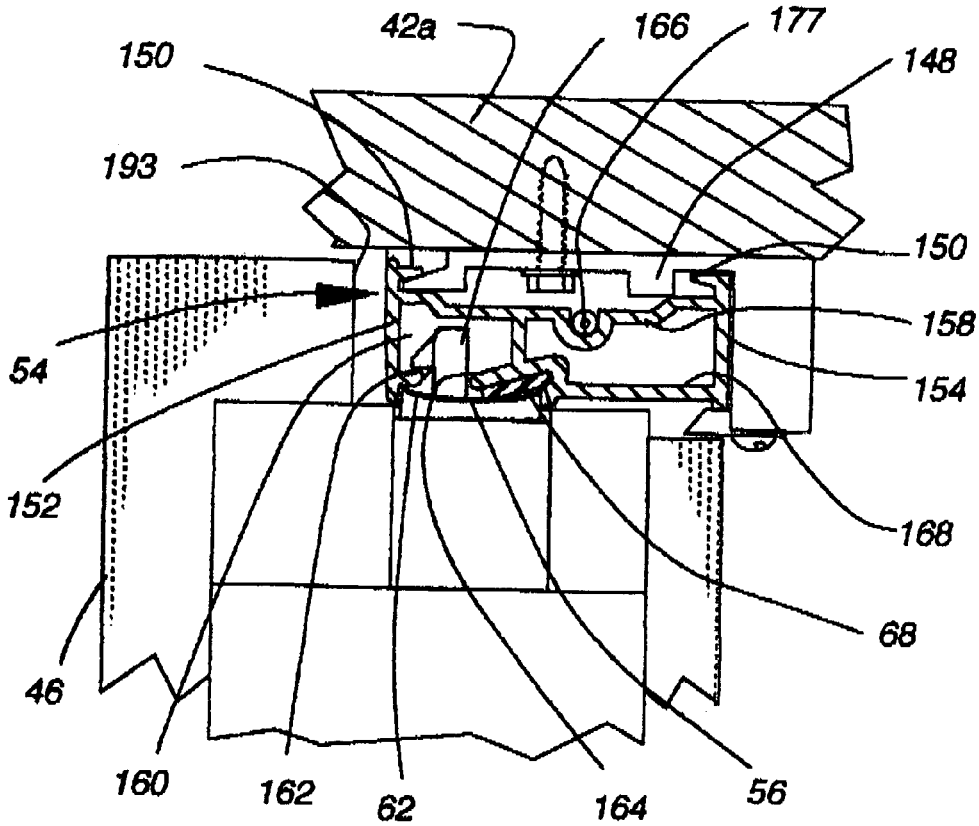
FIG. 7 is an enlarged fragmentary section taken along line 7-7 of FIG. 4.

The top rail 54, possibly best seen in FIGS. 1D and 7, is an extrusion supported on the undersurface of the top frame member 42*a* of the architectural opening with brackets 148. The extrusion has a pair of inturned lips 150 on its upper surface adapted to cooperate with the mounting brackets 148 in supporting the top rail and longitudinally extending front 152, back 154, and intermediate walls 156 depending from a top wall 158. The front wall and intermediate wall define a space or gap 160 in cooperation with the top wall with the front wall having an inturned lower lip 162 spaced from an inturned lower lip 164 on the intermediate wall. The gap between the inturned lips on the front and intermediate walls is adapted to slidably receive hangers 166 for the fabric 46 as well as slide pins 167 (FIGS. 1D and 12) on the top of the top plug 72 of the movable vertical rails which will be described hereafter. The inturned lip 162 on the front wall defines a slidable support for the hangers and the top plug 72 so that the fabric and top plug are slidably suspended from the top rail. A bottom wall 168 of the top rail extends between the intermediate wall 156 and the back wall 154 with the bottom wall having a recess 170 formed in its bottom surface in which the magnetic tape 68 is secured with adhesive or other suitable means. As can be seen in FIG. 7, the flexible metal tape 56 along its upper horizontal run lies beneath the front half of the top rail and overlaps along its rearmost edge the magnetic tape so that the metal tape remains removably adhered to the magnetic tape along its upper horizontal run and covers a portion of the bottom of the top rail that is otherwise exposed when the covering is retracted or partially retracted for aesthetic purposes.

Figure 8A:
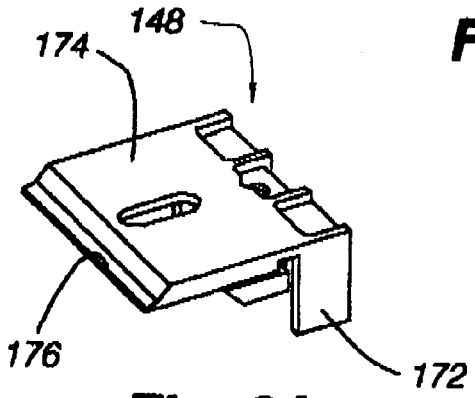
FIG. 8A is an isometric looking downwardly on the mounting bracket for the top rail of the covering of the present invention.
Figure 8B:
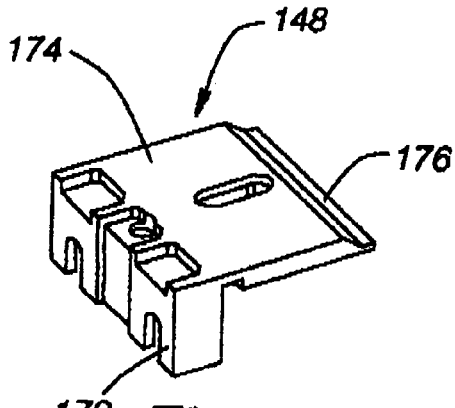
FIG. 8B is an isometric looking downwardly on the mounting bracket shown in FIG. 8A from a different direction.
Figure 8C:
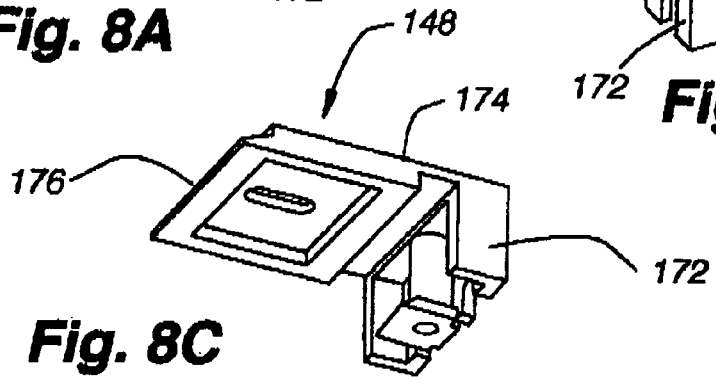
Figure 9:
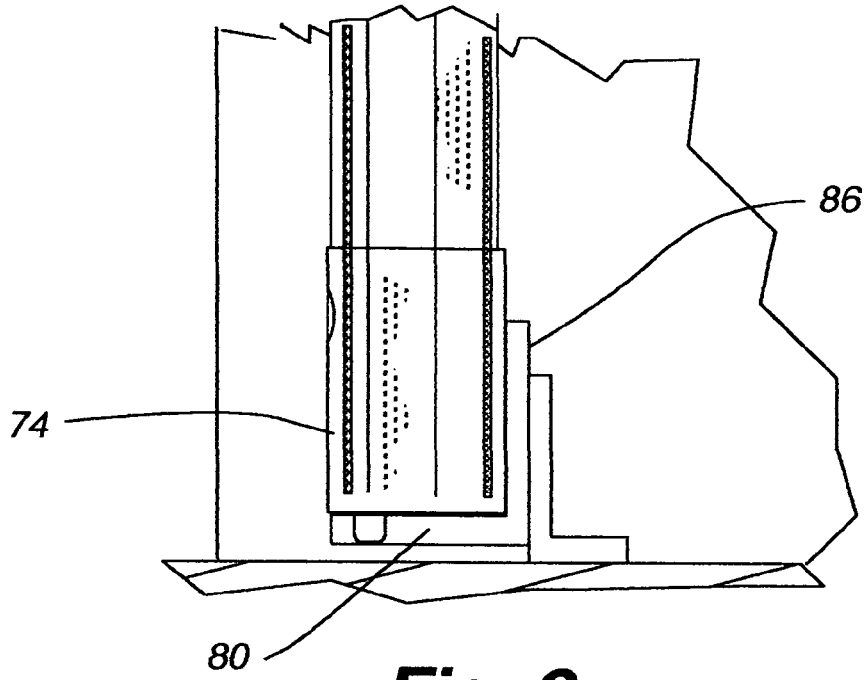
FIG. 9 is an enlarged fragmentary section taken along line 9-9 of FIG. 4.
Figure 11:
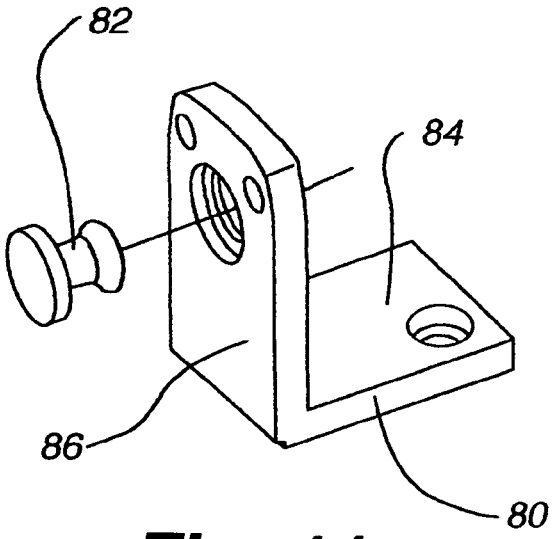
FIG. 11 is an exploded isometric of the mounting bracket for the fixed vertical rail of the covering.
Figure 10:
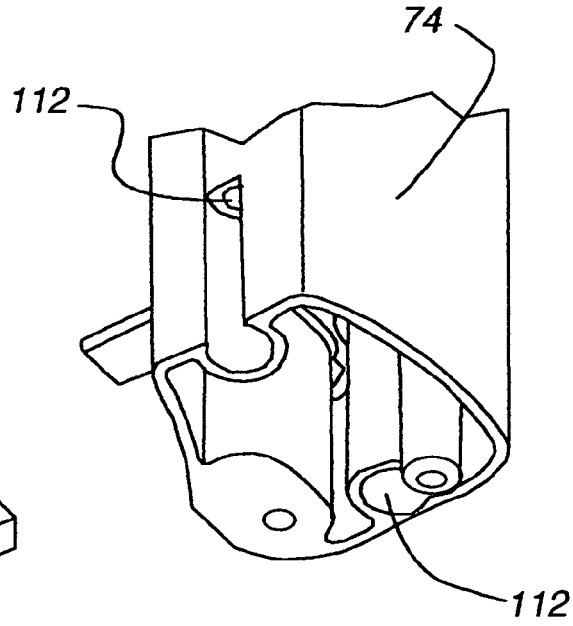
FIG. 10 is fragmentary isometric looking upwardly at the bottom end plug of the vertical rails of the covering of the present invention.

The mounting or support brackets 148 for the top rail 54 are shown in FIGS. 8A and 8B to have a vertical leg 172 and a horizontal leg 174 with the vertical leg being adapted to be secured to a vertical support surface within the frame 42 of the architectural opening and the horizontal leg secured to a horizontal frame member in the architectural opening. Depending on the desired positioning of the top rail, the vertical leg or horizontal leg of the bracket 148 can be anchored to the frame of the architectural opening in a manner such that a tapered lip 176 on the free edge of the horizontal leg can cooperate with a lip 150 on the top rail to releasably secure the top rail to the frame 42.

Figure 13A:
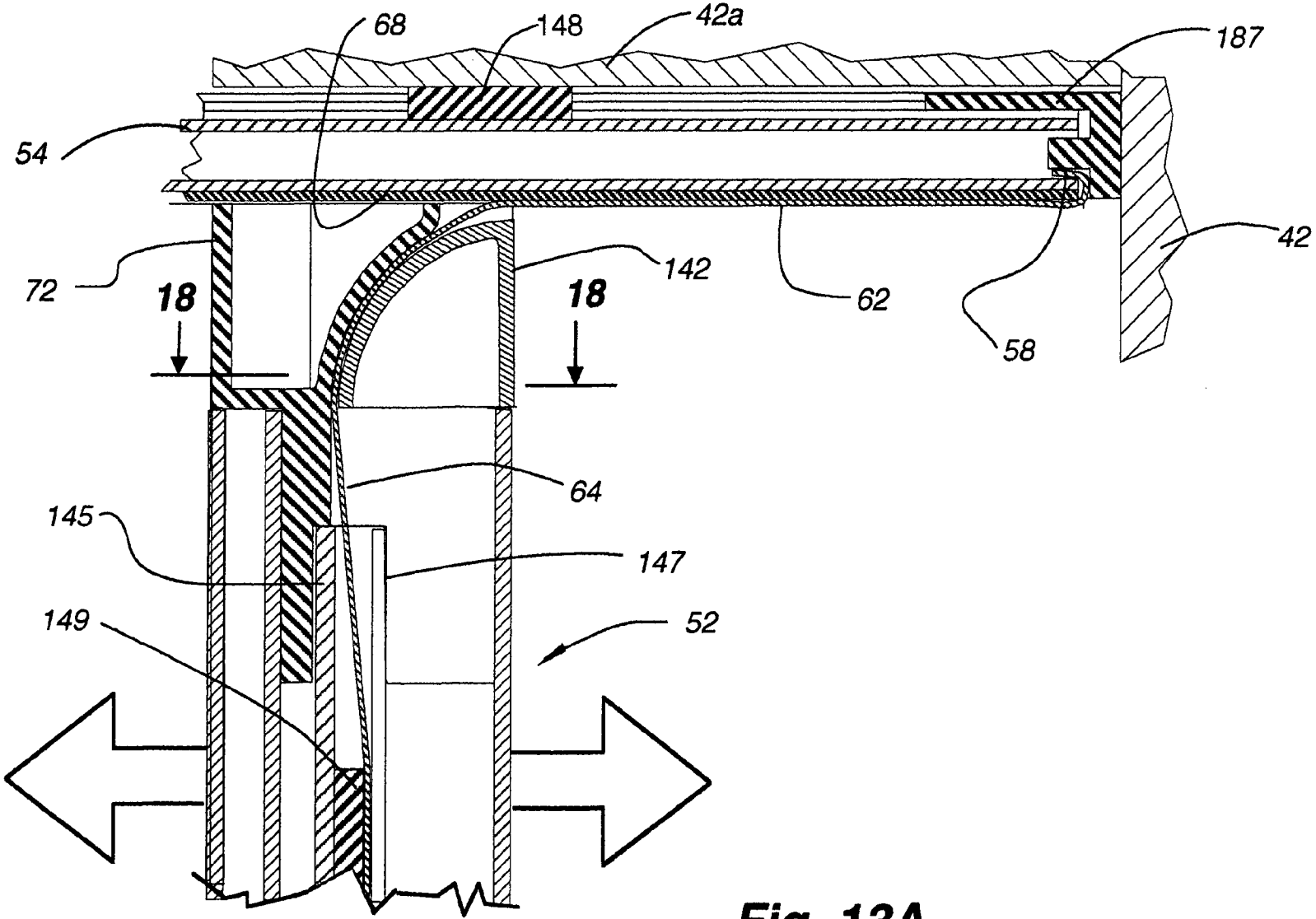
FIG. 13A is a fragmentary section taken along line 13A-13A of FIG. 12.
Figure 13B:
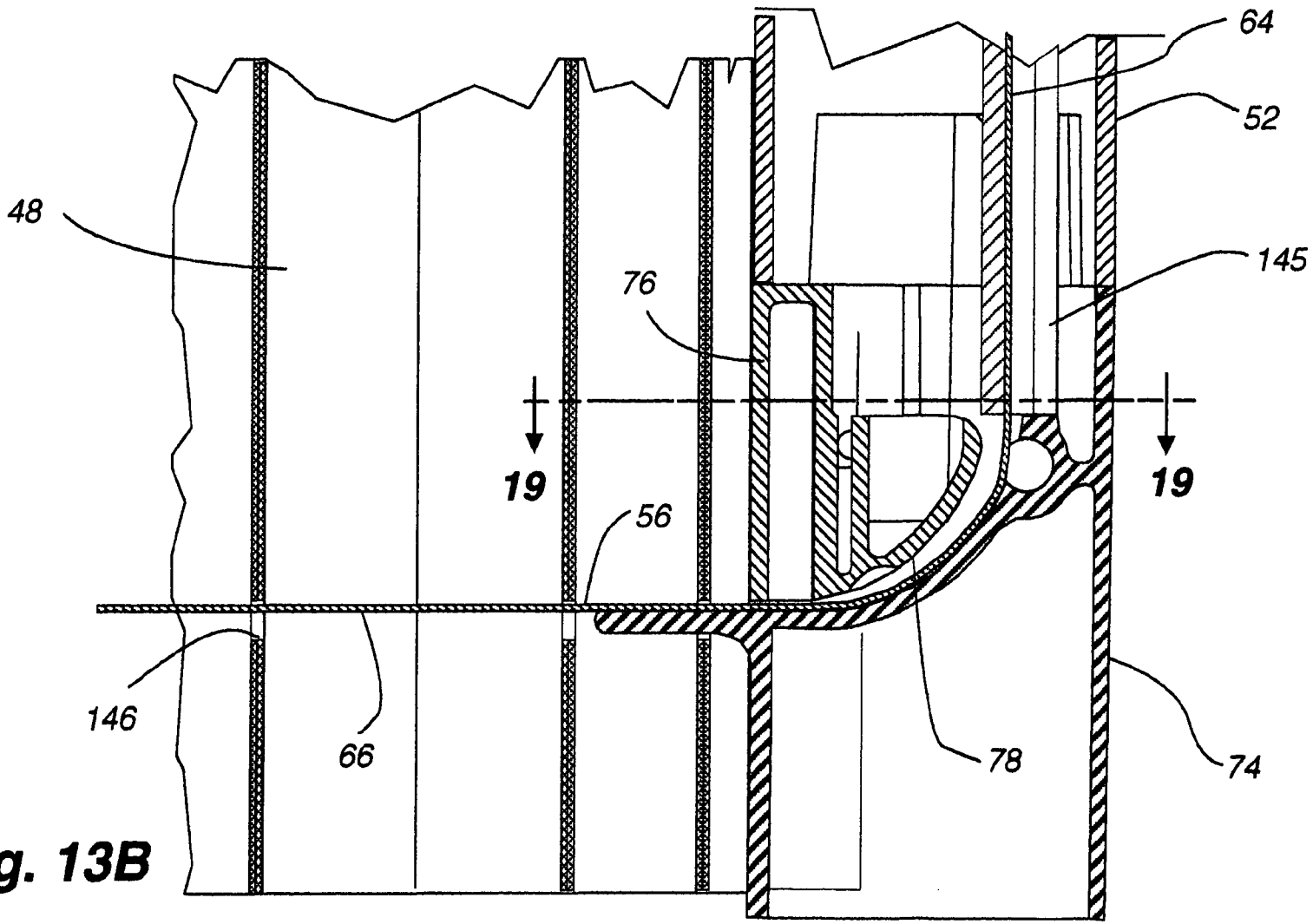
FIG. 13B is an enlarged fragmentary section taken along line 13B-13B of FIG. 12.

FIG. 13A illustrates the manner in which the top end 58 of the flexible metal guide tape 56 is operatively anchored to the frame 42 of the opening so as to be in a fixed position. As will be appreciated, as the tape transgresses from its vertical run 64 to its horizontal upper run 62 through the top plug 72 of the movable vertical rail 52, it extends along the underside of the top rail 54 and is magnetically attracted thereto by the magnetic tape 68 so as to remain in close adjacent relationship with the bottom of the top rail. When the flexible metallic tape 56 reaches the right end of the top rail, it is turned upwardly and reversed in direction so that it wraps around the end of the top rail. It is secured to the top rail by an end cap 151 (FIG. 14), which is inserted into the open end of the top rail and held therein with a fastener inserted through the end cap into the open end of a longitudinal C-groove 177 (FIGS. 1D and 7) in the top rail. It will be appreciated from the above that the upper end of the flexible metal tape is operatively anchored to the frame 42 of the architectural opening as is the bottom end of the tape so that the ends of the tape do not move as the movable vertical rail 52 is slid horizontally between its extended and retracted positions. Rather, the guide tape is allowed to slide through the movable rail and be peeled off the magnetic tape 68 as the movable rail is moved toward the extended position of the covering but laid back against the magnetic tape as the movable rail is moved toward its retracted position.

Figure 14:
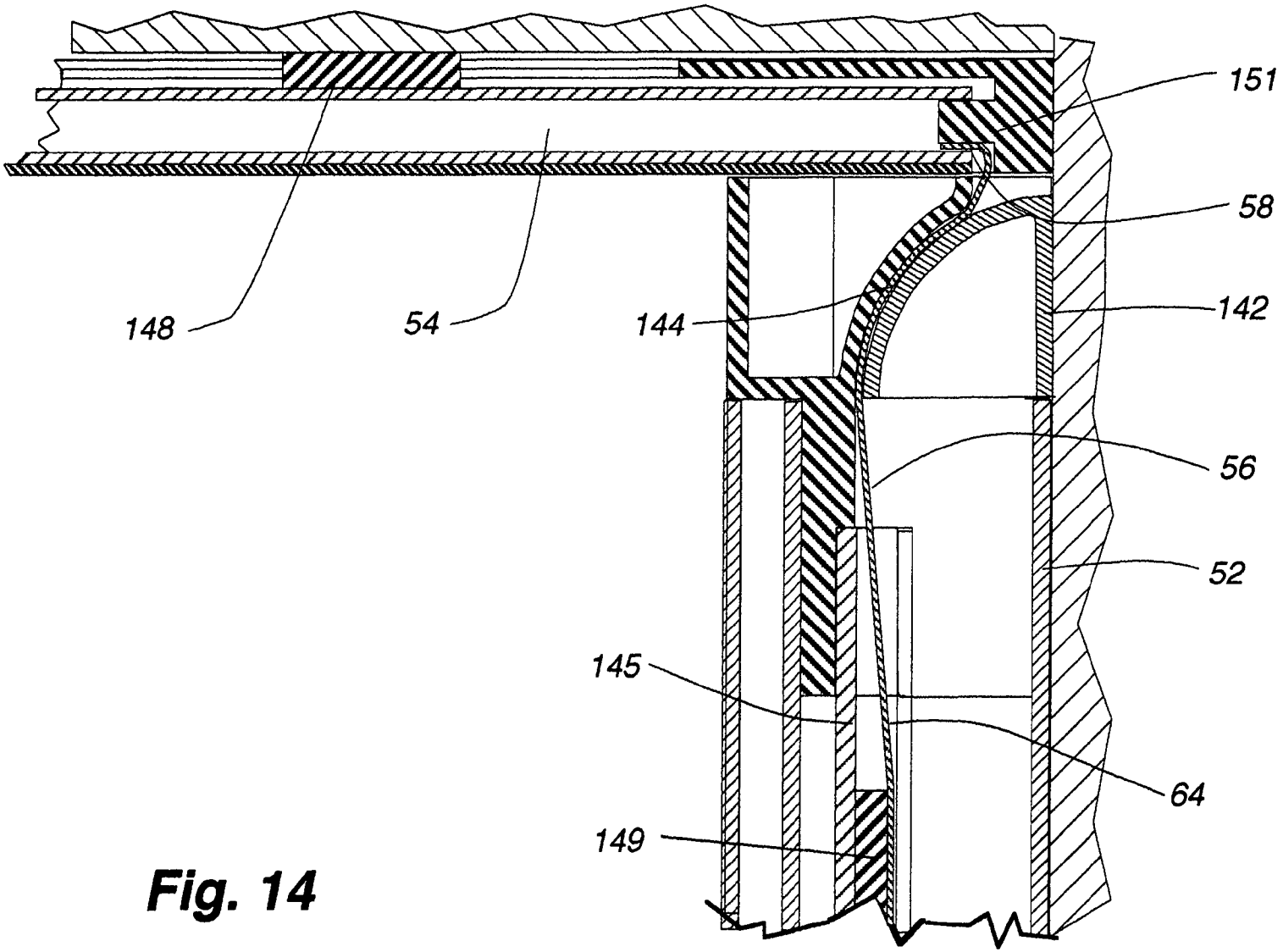
FIG. 14 is a fragmentary section similar to FIG. 13A with the covering in a fully extended position.

As best appreciated by reference to FIG. 14, when the covering is in the fully extended position, the flexible metal tape 56 at the right end of the top rail passes through a reverse curve. The reverse curve in the spring steel, which is biased toward a straightened condition, establishes a bias toward closure of the covering, or full extension, that releasably holds the covering in the fully extended position with the movable vertical rail against the right side frame member 42*d* of the architectural opening. Of course, this detent is overcome by manual force when the movable rail is pulled toward the retracted position of the covering.

Figure 15A:
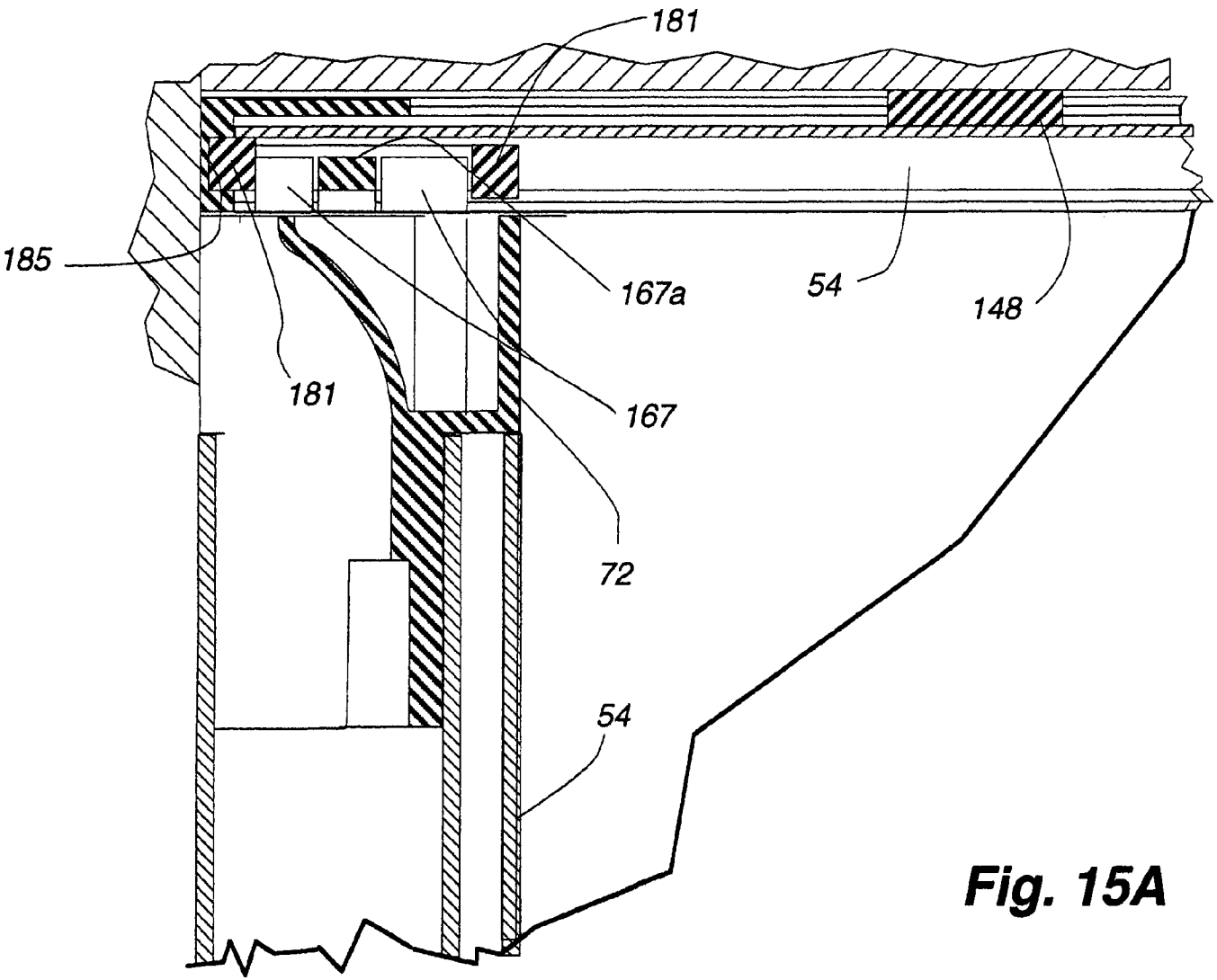
FIG. 15A is an enlarged fragmentary section taken along line 15A-15A of FIG. 12.
Figure 15B:
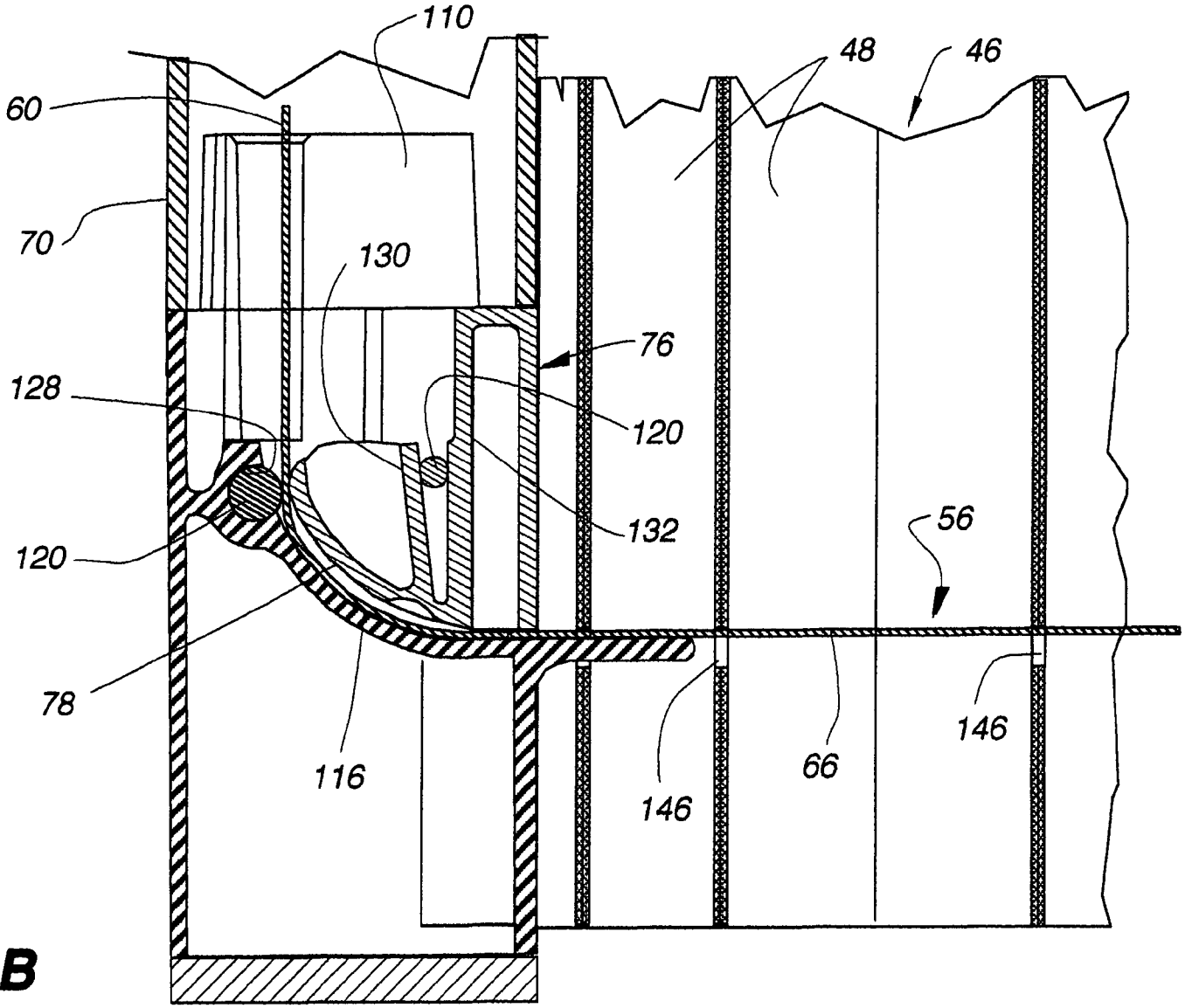
FIG. 15B is an enlarged vertical section taken along line 15B-15B of FIG. 12.

The top rail 54 is secured to the top plug 72 of the fixed vertical rail 50 with a connector 153 seen best in FIGS. 1D, 12 and 15A. The connector is configured similar to a dog bone having enlarged opposite ends 181 and a space bar 183 between the ends. The connector is insertable into the gap 160 in the bottom of the top rail between the front wall 152 and the intermediate wall 156. One enlarged end of the connector is seated in a recess 185 provided in an end cap 187 at the left end of the top rail 54 which is secured to the top rail identically to the end cap 151 at the right end described previously. In other words, a screw-type fastener passes through an opening in the left end cap and is threadedly received in the longitudinal C-groove 177 provided in the top rail. Accordingly, the end cap 187 assists in holding the connector in position within the top rail and the space bar 183 confines the slide pins 167 on the top plug 72 within the downwardly opening gap 160 in the top rail so that the top plug cannot be removed without removal of the left end cap. As will be appreciated, of the three slide pins 167 on the top plug, the middle pin 167*a* has an overhang adapted to be received on the inturned lip 162 along the lower edge of the front wall of the top rail and the spacer bar 183 retains the slide pins in a position so that the overhanging lip on the center slide pin remains supported by the inturned lip on the top rail.

As seen best in FIGS. 30-33, the top edge of the fabric 46 is slidably connected to the top rail 54 with a plurality of the hangers 166. The hangers have a vertical lower leg 180 with compressible laterally extending side pins 182 and a trifurcated upper leg 184 with two forward legs 186 having a hook-shaped top edge and one centered rearward leg 188. The distance from the front and back of the trifurcated upper leg 184 corresponds generally with the gap between the inturned lips 162 and 164 along the bottom of the front and intermediate walls of the top rail 54 so that the hook-shaped top edges of the two forward legs 186 overhang the inturned lip 162 of the front wall. In this manner, the hanger pin is slidably suspended vertically from the top rail.

Vertically aligned holes 190 are provided through top edges of selected ones of the tubular cells 48 in the fabric 46 with the holes being alignable with the compressible pins 182 on the hangers. The compressible pins on the hangers are inserted through the holes 190 and a pair of reinforcement clips 192 are adapted to be snapped onto the compressible pins on the opposite side of the fabric material from the lower leg of the hanger so that the hanger is securely attached to the top edge of the fabric. The two clips are preferably made of different materials with the clip facing the fabric material being of a softer material which does not damage the fabric and the outer clip being of a harder material to provide a positive grip on the compressible pins. Hangers 178 are mounted along the top edge of the fabric at desirably spaced intervals so that the fabric hangs vertically as desired with no sagging along its top edge.

It will be noted the fabric material has a depth and top edge of the fabric material is notched at 193 so that the front edge of the material is higher than the back edge and the top rail 54 is received in said notch. The higher front edge of the fabric is adjacent to the top frame member and therefore conceals the depth dimension of the top rail from top to bottom as possibly best seen in FIG. 30 giving a more finished look to the product.

In operation of the shade moving from the fully retracted position of FIG. 3 to the fully extended position of FIG. 1, it will be seen in FIG. 3 that the movable vertical rail 52 is positioned in closely spaced relationship with the fixed vertical rail 50 and with the fabric material 46 gathered and compressed therebetween with each cell 48 of the fabric being laterally compressed into a small horizontal stack. The lower horizontal run 66 of the metallic tape 56 would be very short in extending simply from the fixed vertical rail 50 through the slots 146 in the fabric into the lower end of the movable vertical rail 52 and the upper horizontal run 62 of the metallic tape would be relatively long extending from the top end of the movable vertical rail to the right upper end of the architectural opening. As the movable rail is moved to the right to the position of FIG. 2, for example, the lower horizontal run 66 of the metallic tape becomes longer while the upper horizontal run 62 becomes correspondingly shorter and in the position of FIG. 2, the upper and lower runs of the flexible metallic guide tape are approximately the same. Of course, as the movable vertical rail is sliding to the right, the metallic tape is sliding vertically within the movable vertical rail. The hanger pins 178 are sliding along the top rail so that the upper edge of the fabric is supported in a horizontal line parallel with the top rail. When the movable rail gets to the right side of the architectural opening in the fully extended position of FIG. 1, the lower horizontal run of the metallic tape is at its maximum length extending almost the full width of the architectural opening and through the passages adjacent to the bottom edge of the fabric. The top run of the metallic tape is virtually negligible as seen in FIG. 14.

The metal guide tape 56 is flexible but has some rigidity and therefore retains the movable vertical rail 52 with the assistance of the magnetic tape at any desired position between fully extended and fully retracted positions as a user may desire. The tape also provides a reliable guide for the vertical rail so it moves easily between selected positions.

Although the present invention has been described with a certain degree of particularity, it is understood that the present disclosure has been made by way of example, and changes in detail or structure may be made without departing from the spirit of the invention as defined in the appended claims.

The invention claimed is:

1. A retractable covering for an architectural opening having a quadrilateral frame with first, second, third and fourth mutually perpendicular sides with the first side being opposite the third side and the second side opposite the fourth side, said covering comprising in combination:

a flexible fabric corresponding in configuration to the configuration of said frame and adapted to retractably extend across said opening, said fabric having first, second, third, and fourth side edges corresponding to said sides of said frame;

a fixed rail secured to said second side edge of said fabric and to said second side of said frame to secure said side edge of said fabric to said second side of said frame;

a movable rail secured to said fourth side edge of said fabric and movable between said second and fourth sides of said frame, said movable rail having a channel therethrough; and a flexible guide tape having a first end operatively secured to said frame near the intersection of said first and fourth sides thereof and extending along said first side to one end of said movable rail, then extending along said channel to the opposite end of said movable rail and subsequently extending along said third side of said frame and being operatively secured at its opposite end to said frame near the intersection of said second and third sides of said frame;

whereby as said movable rail is moved between said second and fourth sides of said frame, said guide tape slides within said channel;

said movable rail including top and bottom end plugs having arcuate ramp surfaces for slidably diverting the direction of said guide tape;

said fixed rail having an end plug adjacent to said third side of said frame, said end plug including an arcuate ramp surface for slidably diverting the direction of said guide tape and a connector for securing the guide tape to the end plug to prevent movement of the guide tape relative to the end plug, wherein said connector includes components on opposite sides of said guide tape for pinching the guide tape between said components and wherein one of said components is a flexible segment of said end plug.

2. A retractable covering for an architectural opening having a quadrilateral frame with first, second, third and fourth mutually perpendicular sides with the first side being opposite the third side and the second side opposite the fourth side, said covering comprising in combination:

a flexible fabric corresponding in configuration to the configuration of said frame and adapted to retractably extend across said opening, said fabric having first, second, third, and fourth side edges corresponding respectively to said sides of said frame;

a fixed rail secured along its length to said second side edge of said fabric and to said second side of said frame to operatively secure said second side edge of said fabric to said second side of said frame;

a movable rail secured to said fourth side edge of said fabric and movable between said second and fourth sides of said frame, said movable rail having a channel therethrough; and a flexible guide tape having a first end operatively secured to said frame near the intersection of said first and fourth sides thereof and extending along said first side to one end of said movable rail, then extending along said channel to the opposite end of said movable rail and subsequently extending along said third side of said frame and being operatively secured at its opposite end to said frame near the intersection of said second and third sides of said frame;

whereby as said movable rail is moved between said second and fourth sides of said frame, said guide tape slides within said channel;

said movable rail including end plugs at its opposite ends having arcuate ramp surfaces for slidably diverting the direction of said guide tape;

said movable rail further including a longitudinally extending guide in said channel, said guide being of trough shaped configuration and slidably confining said tape, and a magnet in said guide in sliding engagement with said tape said fixed rail having an end plug adjacent to said third side of said frame, said end plug including an arcuate ramp surface for slidably diverting the direction of said guide tape and a connector for securing the guide tape to the end plug to prevent movement of the guide tape relative to the end plug, wherein said connector includes components on opposite sides of said guide tape for pinching the guide tape between said components and wherein one of said components is a flexible segment of said end plug.

3. The covering of claim 2 wherein said magnet is elongated so as to extend along a substantial portion of the length of said guide.

4. A retractable covering for an architectural opening having a quadrilateral frame with first, second, third and fourth mutually perpendicular sides with the first side being opposite the third side and the second side opposite the fourth side, said covering comprising in combination:

a flexible fabric corresponding in configuration to the configuration of said frame and adapted to retractably extend across said opening, said fabric having first, second, third, and fourth side edges corresponding respectively to said sides of said frame;

a fixed rail secured along its length to said second side edge of said fabric and to said second side of said frame to operatively secure said second side edge of said fabric to said second side of said frame;

a movable rail secured to said fourth side edge of said fabric and movable between said second and fourth sides of said frame, said movable rail having a channel therethrough; and a flexible guide tape having a first end operatively secured to said frame near the intersection of said first and fourth sides thereof and extending along said first side to one end of said movable rail, then extending along said channel to the opposite end of said movable rail and subsequently extending along said third side of said frame and being operatively secured at its opposite end to said frame near the intersection of said second and third sides of said frame;

whereby as said movable rail is moved between said second and fourth sides of said frame, said guide tape slides within said channel;

said movable rail extending vertically and including top and bottom end plugs having arcuate ramp surfaces for slidably diverting the direction of said guide tape;

wherein said first side of said frame defines the top of said architectural opening and further including a top rail secured to and extending along said first side of said frame, said top rail including a downwardly opening channel and an adjacent shoulder, and a plurality of hangers secured to said first side of said fabric, said hangers being slidably supported on said shoulder and further wherein said guide tape underlies said channel in said top rail between said movable rail and said fourth side of said frame to conceal said channel in said top rail from view said fixed rail having an end plug adjacent to said third side of said frame, said end plug including an arcuate ramp surface for slidably diverting the direction of said guide tape and a connector for securing the guide tape to the end plug to prevent movement of the guide tape relative to the end plug, wherein said connector includes components on opposite sides of said guide tape for pinching the guide tape between said components and wherein one of said components is a flexible segment of said end plug.

5. A retractable covering for an architectural opening having a quadrilateral frame with first, second, third and fourth mutually perpendicular sides with the first side being opposite the third side and the second side opposite the fourth side, said covering comprising in combination:

a flexible fabric corresponding in configuration to the configuration of said frame and adapted to retractably extend across said opening, said fabric having first, second, third, and fourth side edges corresponding respectively to said sides of said frame;

a fixed rail secured along its length to said second side edge of said fabric and to said second side of said frame to operatively secure said second side edge of said fabric to said second side of said frame;

a movable rail secured to said fourth side edge of said fabric and movable between said second and fourth sides of said frame, said movable rail having a channel therethrough; and a flexible guide tape having a first end operatively secured to said frame near the intersection of said first and fourth sides thereof and extending along said first side to one end of said movable rail, then extending along said channel to the opposite end of said movable rail and subsequently extending along said third side of said frame and being operatively secured at its opposite end to said frame near the intersection of said second and third sides of said frame;

whereby as said movable rail is moved between said second and fourth sides of said frame, said guide tape slides within said channel;

said movable rail including end plugs at opposite ends thereof having arcuate ramp surfaces for slidably diverting the direction of said guide tape;

said flexible guide tape being inherently biased toward a straight configuration and having a portion thereof maintained in a curved orientation when said movable rail is contiguous with said fourth side of said frame so that said flexible guide tape biases said movable rail against said fourth side of said frame said fixed rail having an end plug adjacent to said third side of said frame, said end plug including an arcuate ramp surface for slidably diverting the direction of said guide tape and a connector for securing the guide tape to the end plug to prevent movement of the guide tape relative to the end plug, wherein said connector includes components on opposite sides of said guide tape for pinching the guide tape between said components and wherein one of said components is a flexible segment of said end plug.

6. The covering of claim 5 wherein said movable rail has an additional ramp surface at the end thereof adjacent to said first side of said frame and across which said flexible guide tape passes, said ramp surface sloping generally toward the intersection of said second and third sides of said frame, said ramp surface maintaining said curved orientation of said flexible guide tape.

7. The covering of claim 6 further including an insert in the end of said movable rail adjacent to said first side of said frame and wherein said insert is in said end plug.

8. A retractable covering for an architectural opening having a quadrilateral frame with first, second, third and fourth mutually perpendicular sides with the first side being opposite the third side and the second side opposite the fourth side, said covering comprising in combination:

a flexible fabric corresponding in configuration to the configuration of said frame and adapted to retractably extend across said opening, said fabric having first, second, third, and fourth side edges corresponding respectively to said sides of said frame;

a fixed rail secured along its length to said second side edge of said fabric and to said second side of said frame to operatively secure said second side edge of said fabric to said second side of said frame;

a movable rail secured to said fourth side edge of said fabric and movable between said second and fourth sides of said frame, said movable rail having a channel therethrough; and a flexible guide tape having a first end operatively secured to said frame near the intersection of said first and fourth sides thereof and extending along said first side to one end of said movable rail, then extending along said channel to the opposite end of said movable rail and subsequently extending along said third side of said frame and being operatively secured at its opposite end to said frame near the intersection of said second and third sides of said frame;

whereby as said movable rail is moved between said second and fourth sides of said frame, said guide tape slides within said channel;

said movable rail including end plugs at its opposite ends having arcuate ramp surfaces for slidably diverting the direction of said guide tape;

said fabric including an elongated cell along said fourth side edge of the fabric and said movable rail having an open recess along its length adapted to receive said elongated cell and further including a retention rod inserted in said cell within said open recess to secure said fourth side edge of said fabric to said movable rail said fixed rail having an end plug adjacent to said third side of said frame, said end plug including an arcuate ramp surface for slidably diverting the direction of said guide tape and a connector for securing the guide tape to the end plug to prevent movement of the guide tape relative to the end plug, wherein said connector includes components on opposite sides of said guide tape for pinching the guide tape between said components and wherein one of said components is a flexible segment of said end plug.

9. The covering of claim 8 wherein said elongated cell is formed from a hem along said fourth side edge of said fabric.

10. The covering of claim 2 wherein said movable rail includes a first inclined ramp at its end adjacent to said third side of said frame and wherein said guide tape is slidable along said first ramp to divert the direction of said guide tape.

11. The covering of claim 10 wherein said movable rail includes a second inclined ramp at its end adjacent to said first side of said frame and wherein said guide tape is slidable along said second ramp to divert the direction of said guide tape.

12. The covering of claim 11 wherein said first and second ramps are arcuate.

13. The covering of claim 11 further including first and second inserts in which said first and second ramps are found.

14. A retractable covering for an architectural opening having a quadrilateral frame with first, second, third and fourth mutually perpendicular sides with the first side being opposite the third side and the second side opposite the fourth side, said covering comprising in combination:

a flexible fabric corresponding in configuration to the configuration of said frame and adapted to retractably extend across said opening, said fabric having first, second, third, and fourth side edges corresponding respectively to said sides of said frame;

a fixed rail secured along its length to said second side edge of said fabric and to said second side of said frame to operably secure said second side edge of said fabric to said second side of said frame;

a movable rail secured to said fourth side edge of said fabric and movable between said second and fourth sides of said frame, said movable rail having a channel therethrough; and a flexible guide tape having a first end operatively secured to said frame near the intersection of said first and fourth sides thereof and extending along said first side to one end of said movable rail, then extending along said channel to the opposite end of said movable rail and subsequently extending along said third side of said frame and being operatively secured at its opposite end to said frame near the intersection of said second and third sides of said frame;

whereby as said movable rail is moved between said second and fourth sides of said frame, said guide tape slides within said channel;

said movable rail extends vertically and includes top and bottom end plugs having arcuate ramp surfaces for slidably diverting the direction of said guide tape;

wherein said first side of said frame defines the top of said architectural opening and further including a top rail secured to and extending across said first side of said frame, said top rail having a depth dimension extending away from said first side of said frame, and wherein said first side edge of said fabric has a depth dimension extending perpendicularly to said depth dimension of said top rail and said first side edge of said fabric has a notch extending along said first side edge of the fabric whereby a portion of said fabric along said first side edge underlies said top rail and a portion extends into closely adjacent relationship with said first side of said frame so as to block said top rail from view said fixed rail having an end plug adjacent to said third side of said frame, said end plug including an arcuate ramp surface for slidably diverting the direction of said guide tape and a connector for securing the guide tape to the end plug to prevent movement of the guide tape relative to the end plug, wherein said connector includes components on opposite sides of said guide tape for pinching the guide tape between said components and wherein one of said components is a flexible segment of said end plug.

15. The covering of claim 4 wherein said guide tape is metal and further including an elongated magnet secured to the underside of said top rail to releasably attract and retain said guide tape along the underside of said top rail.

* * * * *